US011781540B2

(12) United States Patent
Lee et al.

(10) Patent No.: US 11,781,540 B2
(45) Date of Patent: Oct. 10, 2023

(54) LINEAR COMPRESSOR

(71) Applicant: LG Electronics Inc., Seoul (KR)

(72) Inventors: Kyunyoung Lee, Seoul (KR); Youngmun Lee, Seoul (KR); Kiwon Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 592 days.

(21) Appl. No.: 16/929,548

(22) Filed: Jul. 15, 2020

(65) Prior Publication Data

US 2021/0054833 A1 Feb. 25, 2021

(30) Foreign Application Priority Data

Aug. 23, 2019 (KR) ..... 10-2019-0103627

(51) Int. Cl.

| | |
|---|---|
| ***F04B 35/04*** | (2006.01) |
| ***F04B 39/12*** | (2006.01) |
| ***F25B 1/02*** | (2006.01) |
| ***F04B 39/00*** | (2006.01) |

(52) U.S. Cl.

CPC ..... *F04B 35/045* (2013.01); *F04B 39/0038* (2013.01); *F04B 39/125* (2013.01); *F25B 1/02* (2013.01); *F04B 39/0061* (2013.01); *F25B 2400/073* (2013.01)

(58) Field of Classification Search

CPC ..... F04B 39/0061; F04B 39/0038; F04B 39/125; F04B 35/045; F25B 2400/07; F25B 2400/073; F25B 1/02

See application file for complete search history.

(56) References Cited

U.S. PATENT DOCUMENTS

| | | | | |
|---|---|---|---|---|
| 6,457,947 | B1 * | 10/2002 | Seipel | F04B 39/06 417/DIG. 1 |
| 6,824,365 | B2 * | 11/2004 | Park | F04B 39/0061 181/403 |
| 6,902,381 | B2 * | 6/2005 | Hur | F04B 39/125 417/570 |
| 7,540,720 | B2 * | 6/2009 | Enokijima | F04B 39/06 417/313 |
| 8,057,200 | B2 * | 11/2011 | Kang | F04B 39/0055 417/571 |

(Continued)

FOREIGN PATENT DOCUMENTS

| | | |
|---|---|---|
| CN | 102251950 | 11/2011 |
| CN | 102297118 | 12/2011 |

(Continued)

OTHER PUBLICATIONS

Office Action in Chinese Appln. No. 202010776832.8, dated Feb. 14, 2022, 15 pages (with English translation).

(Continued)

*Primary Examiner* — Christopher S Bobish

(74) *Attorney, Agent, or Firm* — Fish & Richardson P.C.

(57) ABSTRACT

A linear compressor includes a cylinder, a frame, and a discharge unit. The discharge unit includes a discharge cover coupled with the frame, a discharge plenum disposed inside the discharge cover to define a plurality of discharge spaces, (Continued)

and an insulating plenum provided in a shape corresponding to an inner surface of the discharge cover to contact the inner surface of the discharge cover.

19 Claims, 13 Drawing Sheets

(56) References Cited

U.S. PATENT DOCUMENTS

| | | | | |
|---|---|---|---|---|
| 8,366,415 | B2 * | 2/2013 | Kang | F04B 35/045 417/416 |
| 8,858,194 | B2 * | 10/2014 | Moreira | F04B 39/0061 181/403 |
| 9,080,562 | B2 * | 7/2015 | Moreira | F04B 53/007 |
| 9,909,581 | B2 * | 3/2018 | Lilie | F04B 39/0055 |
| 2001/0031208 | A1 * | 10/2001 | Chintamani | F02M 35/10321 181/403 |
| 2005/0106034 | A1 * | 5/2005 | Enokijima | F04B 27/1081 417/313 |
| 2005/0142014 | A1 * | 6/2005 | Jung | F04B 35/045 417/540 |
| 2009/0155114 | A1 * | 6/2009 | Kwan | F04B 39/125 418/179 |
| 2012/0063937 | A1 * | 3/2012 | Moreira | F04B 39/122 417/437 |
| 2015/0004014 | A1 * | 1/2015 | Kim | F04B 35/045 417/312 |
| 2017/0204841 | A1 * | 7/2017 | Jeon | F04B 39/10 |
| 2017/0321676 | A1 | 11/2017 | Ha et al. | |
| 2018/0051683 | A1 * | 2/2018 | Hahn | F04B 39/005 |
| 2018/0238313 | A1 * | 8/2018 | Hahn | F04B 39/0061 |

FOREIGN PATENT DOCUMENTS

| | | |
|---|---|---|
| CN | 107339225 | 11/2017 |
| CN | 108302004 | 7/2018 |
| CN | 109322811 | 2/2019 |
| JP | S59218323 | 12/1984 |
| JP | 2005240562 | 9/2005 |
| KR | 20170124903 | 11/2017 |
| KR | 101940489 | 1/2019 |
| KR | 20190032885 | 3/2019 |
| KR | 1020190040812 | 4/2019 |
| KR | 1020190040814 | 4/2019 |
| KR | 101991443 | 6/2019 |
| WO | WO2016066213 | 5/2016 |

OTHER PUBLICATIONS

KR Notice of Allowance in Korean Appln. No. 10-2019-0103627, dated Nov. 10, 2020, 4 pages (with English translation).

Notice of Allowance in Chinese Appln. No. 202010776832.8, dated Jul. 27, 2022, 6 pages (with English translation).

Korean Office Action in Korean Appln. No. 10-2019-0103627, dated May 29, 2020, 13 pages (with English translation).

Extended European Search Report in EP Appln. No. 20188147.1, dated Jan. 28, 2021, 4 pages.

* cited by examiner

LINEAR COMPRESSOR

CROSS-REFERENCE TO RELATED APPLICATION

This application is based on and claims the benefit of priority to Korean Patent Applications No. 10-2019-0103627, filed on Aug. 23, 2019, in the Korean Intellectual Property Office, the disclosure of which is incorporated herein in its entirety by reference.

TECHNICAL FIELD

The present disclosure relates to a linear compressor.

BACKGROUND

Generally, a compressor, which is a mechanical device that receives power from a power generating device such as an electric motor or a turbine to increase pressure by compressing air, refrigerant, or various other operating gases, has been widely used in household appliances or the industry as a whole.

Such compressors can be roughly classified into reciprocating compressors, rotary compressors, and scroll compressors.

The reciprocating compressor forms a compression space into or from compressing a working gas is sucked or discharged between a piston and a cylinder and compresses a refrigerant in such a way that the piston linearly reciprocates within the cylinder.

In addition, the rotary compressor has a compression space through which a working gas is sucked or discharged between a roller which eccentrically rotates and a cylinder and compress refrigerant while the roller is eccentrically rotated along the inner wall of the cylinder.

In addition, the scroll compressor has a compression space through which a working gas is sucked or discharged between an orbiting scroll and a fixed scroll and compress refrigerant while the orbiting scroll rotates along the fixed scroll.

In recent years, a simple-structured linear compressor of the reciprocating compressors has been developed in which a piston is directly connected to a driving motor that linearly reciprocates to improve compression efficiency without mechanical loss due to motion conversion.

In this case, the linear compressor is configured such that a piston linearly reciprocates within a cylinder by a linear motor in a closed shell to suck and compress refrigerant and then discharge the refrigerant.

At this time, the linear motor is configured such that a permanent magnet is positioned between the inner stator and the outer stator, and the permanent magnet is driven to linearly reciprocate by mutual electromagnetic force between the permanent magnet and the inner (or outer) stator. Furthermore, as the permanent magnet is driven in a state of being coupled to the piston, the piston sucks and compresses refrigerant while reciprocating linearly inside the cylinder, and then discharges the refrigerant.

In connection with the linear compressor having the above-described structure, the applicant has filed Prior Art Document 1.

<Prior Art Document 1>

Korea publication number: 10-2017-0124903 (Publication date: Nov. 13, 2017)

Title of Invention: Linear Compressor

In the prior art document 1, a linear compressor including a piston, a frame in which a cylinder is accommodated, and a discharge cover coupled to the frame is disclosed. The refrigerant compressed by the piston may flow through the discharge cover. In addition, at least a part of the compressed refrigerant may function as a gas bearing between the cylinder and the piston to reduce friction.

In this case, the linear compressor as in the prior art document 1 has the following problems.

As the compressed high-temperature refrigerant flows into the discharge cover, the temperature of the discharge cover is raised, and the temperature of the frame coupled thereto is raised. Accordingly, the temperatures of the cylinder and the piston accommodated inside the frame are raised to overheat sucked refrigerant before being compressed. Accordingly, there is a problem that the volume of the sucked refrigerant increases and the compression efficiency is lowered.

In particular, in the prior art document 1, the compressed high-temperature refrigerant flows directly to the discharge cover. Accordingly, there is a problem that the temperature of the discharge cover greatly increases, and the material of the discharge cover is limited.

Also, a part of the compressed high-temperature refrigerant flows into the cylinder and the piston to function as a gas bearing. Accordingly, there is a problem that the temperature of the cylinder and the piston increases, and the volume of the sucked refrigerant increases, causing a reduction in the compression efficiency.

SUMMARY

The present disclosure has been proposed to solve this problem, and to provide a linear compressor including an insulating plenum disposed in close contact with a discharge cover to prevent the temperature of the discharge cover from being raised due to the compressed high-temperature refrigerant.

Particular implementations of the present disclosure provide a linear compressor that includes a cylinder, a frame, and a discharge assembly that includes a discharge cover, a discharge plenum, and an insulating plenum. The cylinder may define a compression space for compressing refrigerant. The frame may receive the cylinder. The discharge assembly may define a discharge space for discharging the refrigerant. The discharge space may receive the refrigerant from the compression space. The discharge cover may be connected to the frame. The discharge plenum may be disposed on the discharge cover and define the discharge space. The insulating plenum may have a shape that corresponds to at least part of an inner surface of the discharge cover and contacts the at least part of the inner surface of the discharge cover.

In some implementations, the linear compressor described herein may optionally include one or more of the following features. The discharge plenum may be press-fitted to the insulating plenum. The discharge plenum may include a plenum body and a plenum flange extending radially from the plenum body. A radially outer end of the plenum flange may be press-fitted to the insulating plenum. The discharge cover may define an inner space. The inner space may include a first space and a second space. The first space may be positioned at a first axial side of the plenum flange, and the second space may be positioned at a second axial side of the plenum flange opposite to the first axial side of the plenum flange. The plenum body may be disposed in the first space. The insulating plenum may include a material having a lower thermal conductivity than the discharge plenum. The discharge cover, the discharge plenum and the insulating plenum may include different materials from each other. The discharge cover may include aluminum. The discharge plenum may include steel. The insulating plenum may include plastic. The discharge cover may include a chamber portion and a cover flange portion that extends radially from the chamber portion and that is connected to the frame. The insulating plenum may include a first portion and a second portion. The first portion may at least partially contact an inner surface of the cover flange portion. The second portion may at least partially contact an inner surface of the chamber portion. The cover flange portion may include a flange body defining a circular opening, and a flange coupling portion having a flange fastening hole that receives a coupling member. The coupling member may be coupled to the frame. At least a portion of the flange coupling portion may be positioned at an outer side of the flange body in a radial direction. The discharge space may include first, second, and third discharge chambers. The first discharge chamber may be defined at an inner side of the discharge plenum. The second discharge chamber may be defined between the discharge cover and the discharge plenum and disposed axially opposite to the first discharge chamber. The third discharge chamber may be defined between the discharge cover and the discharge plenum and disposed radially outside the first discharge chamber and the second discharge chamber. The linear compressor may include a cover pipe connected to the discharge cover and fluidly communicating with the third discharge chamber. The refrigerant that is discharged from the compression space may flow to the cover pipe by passing through the first discharge chamber, the second discharge chamber, and the third discharge chamber sequentially. An air layer may be defined between the insulating plenum and the discharge cover. The insulating plenum may include a bearing guide groove. The refrigerant may flow through the bearing guide groove to the frame between the insulating plenum and the discharge cover. The bearing guide groove may be defined at a surface of the insulating plenum that contacts the discharge cover. The bearing guide groove may extend through the insulating plenum.

Particular implementations described herein provide a linear compressor that includes a cylinder, a frame, and a discharge assembly that includes a discharge cover and an insulating plenum. The cylinder may define a compression space for compressing refrigerant. The frame may receive the cylinder. The discharge assembly may define a discharge space for discharging the refrigerant. The discharge space may receive the refrigerant from the compression space. The discharge cover may include a chamber portion and a cover flange portion extending radially from the chamber portion. The cover flange portion may be seated on a surface of the frame and connected to the frame. The insulating plenum may have a shape that corresponds to at least part of inner surfaces of the cover flange portion and the chamber portion and contacts at least part of an inner surface of the discharge cover.

In some implementations, the linear compressor described herein optionally includes one or more of the following features. The discharge assembly may include a discharge plenum that is press-fitted to the insulating plenum. The chamber portion may have an outer diameter that is smaller than an outer diameter of the cover flange portion. The discharge space may be defined inside the chamber portion. The insulating plenum may include a first portion and a second portion. The first portion may at least partially contact the inner surface of the cover flange portion. The second portion may at least partially contact the inner surface of the chamber portion.

In some implementations, the present disclosure provides a linear compressor in which the insulating plenum is formed of a material with a low thermal conductivity to effectively reduce heat transferred to the discharge cover and reduce temperatures of a frame, a cylinder, and a piston connected to the discharge cover.

In addition, an object of the present disclosure is to provide a linear compressor having a structure providing a flow path of a refrigerant functioning as a gas bearing in an insulating plenum to lower a temperature of a bearing refrigerant supplied between a cylinder and a piston.

The linear compressor of the present disclosure is characterized to include an insulating plenum having a structure corresponding to an inner surface of a discharge cover. The insulating plenum is made of a material having a low thermal conductivity, such as plastic to prevent high-temperature refrigerant from directly contacting the discharge cover.

The linear compressor according to the present disclosure includes a cylinder defining a compression space of a refrigerant, a frame in a cylinder configured to define a compression space of refrigerant, a frame in which the cylinder is accommodated, and a discharge unit to define a discharge space of the refrigerant through which the refrigerant discharged from the compression space flows.

The discharge unit includes a discharge cover coupled with the frame, a discharge plenum disposed inside the discharge cover to define a plurality of discharge spaces, and an insulating plenum provided in a shape corresponding to an inner surface of the discharge cover to contact the inner surface of the discharge cover.

Meanwhile, the discharge unit includes a discharge cover including a cover flange portion seated on a front surface of the frame in an axial direction and coupled to the frame and a chamber portion extending forward from the cover flange portion in the axial direction, and an insulating plenum provided in a shape corresponding to inner surfaces of the cover flange portion and the chamber portion to contact an inner surface of the discharge cover.

DETAILED DESCRIPTION

Figure 1:
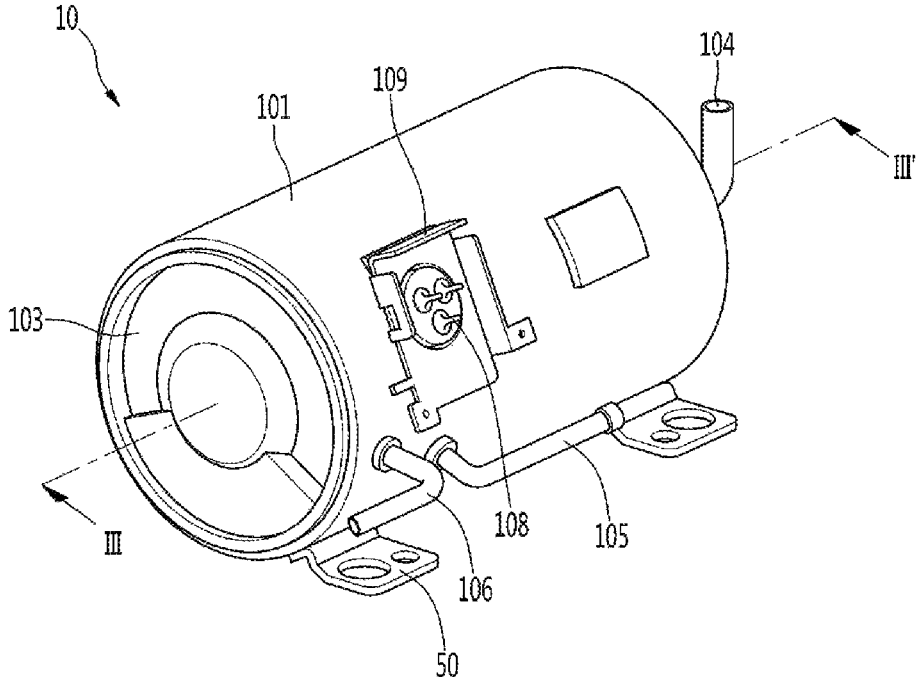
FIG. 1 is a view showing a linear compressor according to an embodiment of the present disclosure.

Hereinafter, some embodiments of the present disclosure will be described in detail with reference to the exemplary drawings. In adding reference numerals to the components of each drawing, it should be noted that the same reference numerals are assigned to the same components as much as possible even though they are shown in different drawings. In addition, in describing the embodiment of the present disclosure, if it is determined that the detailed description of the related known configuration or function interferes with the understanding of the embodiment of the present disclosure, the detailed description thereof will be omitted.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. It should be noted that if it is described in the specification that one component is "connected," "coupled" or "joined" to another component, the former may be directly "connected," "coupled," and "joined" to the latter or "connected", "coupled", and "joined" to the latter via another component.

FIG. 1 is a view showing a linear compressor according to an embodiment of the present disclosure.

As shown in FIG. 1, a linear compressor 10 according to the present disclosure includes a shell 101 and shell covers 102 and 103 coupled to the shell 101. In a broad sense, the shell covers 102 and 103 may be understood as one configuration of the shell 101.

A leg 50 may be coupled to a lower portion of the shell 101. The leg 50 may be coupled to a base of a product in which the linear compressor 10 is installed. For example, the product includes a refrigerator, and the base may include a machine room base of the refrigerator. As another example, the product may include an outdoor unit of an air conditioner, and the base may include a base of the outdoor unit.

The shell 101 has a substantially cylindrical shape, and may be arranged to be laid in a transverse direction or in an axial direction. Referring to FIG. 1, the shell 101 extends to elongate in the transverse direction and may have a somewhat lower height in a radial direction. That is, since the linear compressor 10 is capable of having a low height, it is possible to reduce the height of the machine chamber when the linear compressor 10 is installed in the base of the machine chamber base of the refrigerator.

In other words, a longitudinal center axis of the shell 101 coincides with a center axis of the compressor body, which will be described later, and the central axis of the compressor body coincides with central axes of a cylinder and a piston constituting the compressor body.

A terminal 108 may be provided on an outer surface of the shell 101. The terminal 108 is understood as a configuration that transfers external power to the motor assembly 140 of the linear compressor (see FIG. 3). In particular, the terminal 108 may be connected to a lead line of a coil 141*c* (see FIG. 3).

A bracket 109 is provided on the outside of the terminal 108. A plurality of brackets surrounding the terminal 108 may be included in the bracket 109. The bracket 109 may function to protect the terminal 108 from an external impact or the like.

Both sides of the shell 101 are open. Shell covers 102 and 103 may be coupled to the both open sides of the shell 101.

Specifically, the shell covers 102 and 103 may include a first shell cover 102 (see FIG. 3) coupled to one open side of the shell 101 and a second shell cover 103 coupled to the other open side of the shell 101. The inner space of the shell 101 may be sealed by the shell covers 102 and 103.

Referring to FIG. 1, the first shell cover 102 is positioned on right side of the linear compressor 10, and the second shell cover 103 is positioned on left side of the linear compressor 10.

In other words, the first and second shell covers 102 and 103 may be disposed to face each other. In addition, the first shell cover 102 may be positioned on the suction side of refrigerant, and the second shell cover 103 may be positioned on the discharge side of the refrigerant.

The linear compressor 10 further includes a plurality of pipes 104, 105 and 106 provided in the shell 101 or the shell covers 102 and 103 to suck, discharge or inject refrigerant.

Specifically, the plurality of pipes 104, 105, and 106 may include a suction pipe 104 for causing the refrigerant to be sucked into the inside of the linear compressor 10, a discharge pipe 105 for causing the compressed refrigerant to be discharged from the linear compressor 10, and a process pipe 106 for causing the linear compressor 10 to be replenished with a refrigerant.

For example, the suction pipe 104 may be coupled to the first shell cover 102. The refrigerant is sucked into the linear compressor 10 along the axial direction through the suction pipe 104.

The discharge pipe 105 may be coupled to an outer circumferential surface of the shell 101. The refrigerant sucked through the suction pipe 104 may be compressed while flowing in the axial direction. The compressed refrigerant may be discharged through the discharge pipe 105.

The discharge pipe 105 may be disposed at a position more adjacent to the second shell cover 103 than the first shell cover 102.

The process pipe 106 may be coupled to the outer circumferential surface of the shell 101. An operator may inject the refrigerant into the linear compressor 10 through the process pipe 106.

The process pipe 106 may be coupled to the shell 101 at a different height from that of the discharge pipe 105 to avoid interference with the discharge pipe 105.

The height may be a distance from the leg 50 in the vertical direction. The discharge pipe 105 and the process pipe 106 are coupled to the outer circumferential surface of the shell 101 at the different heights, thereby achieving work convenience.

At least a portion of the second shell cover 103 may be positioned adjacent to the inner peripheral surface of the shell 101, corresponding to a point at which the process pipe 106 is coupled.

In other words, at least a portion of the second shell cover 103 may function as a resistor of refrigerant injected through the process pipe 106.

Therefore, from the viewpoint of the flow path of the refrigerant, the size of the flow path of the refrigerant introduced through the process pipe 106 is formed to decrease due to the second shell cover 103 while entering the interior space of the shell 101 and again increase while passing through the shell 101.

In this process, the pressure of the refrigerant may be reduced to vaporize the refrigerant, and in this case, the oil contained in the refrigerant may be separated.

Therefore, as the refrigerant from which the oil is separated is introduced into the piston 130 (see FIG. 3), the compression performance of the refrigerant may be improved. The oil may be hydraulic oil present in a cooling system.

A device for supporting a compressor body disposed inside the shell 101 may be provided on the inside of the first and second shell covers 102 and 103.

Here, the compressor body refers to a part provided inside the shell 101, and may include, for example, a driving part reciprocating forward and backward and a support portion that supports the driving part.

Hereinafter, the compressor body will be described in detail.

Figure 2:
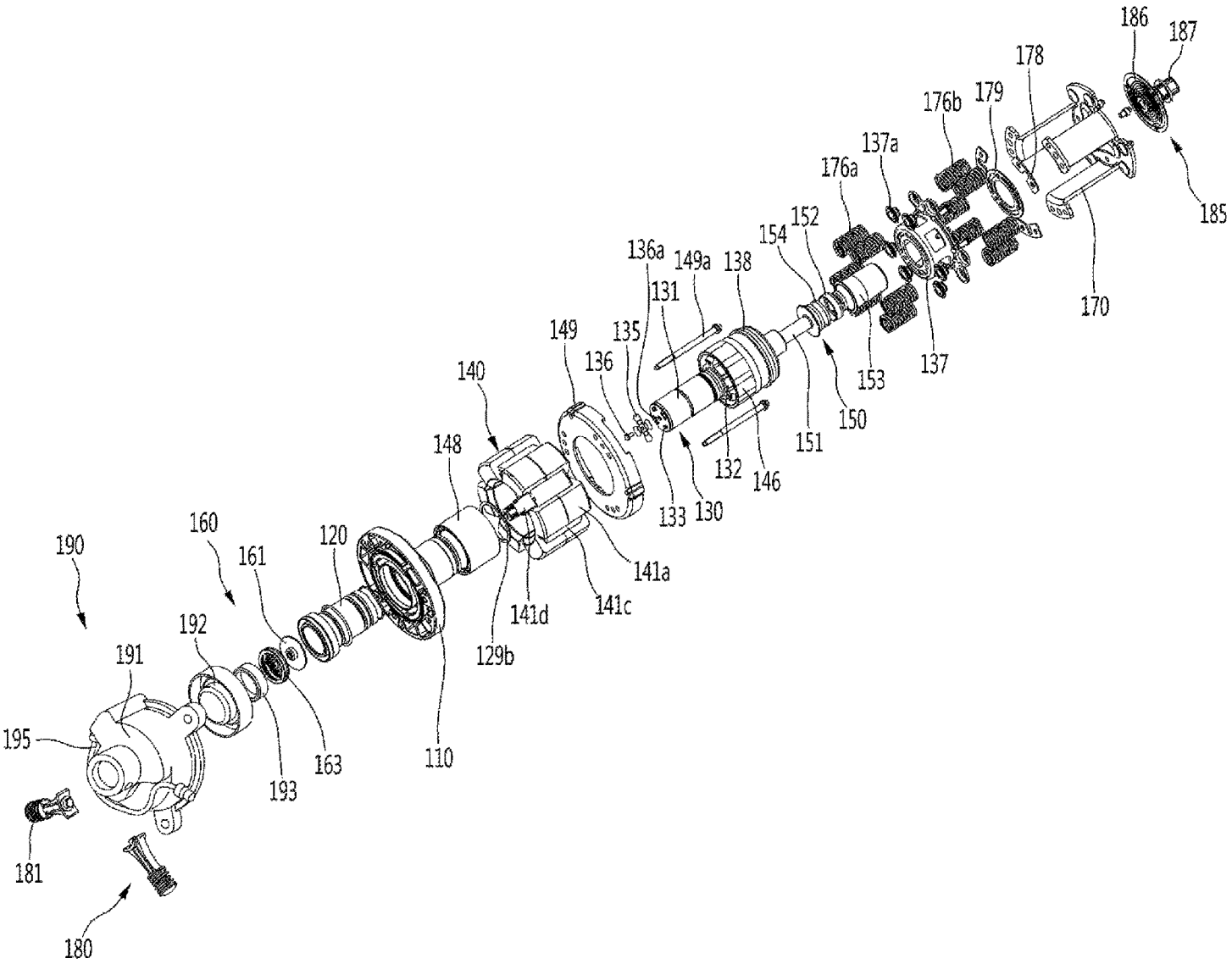
FIG. 2 is an exploded view of an internal configuration of a linear compressor according to an embodiment of the present disclosure.
Figure 3:
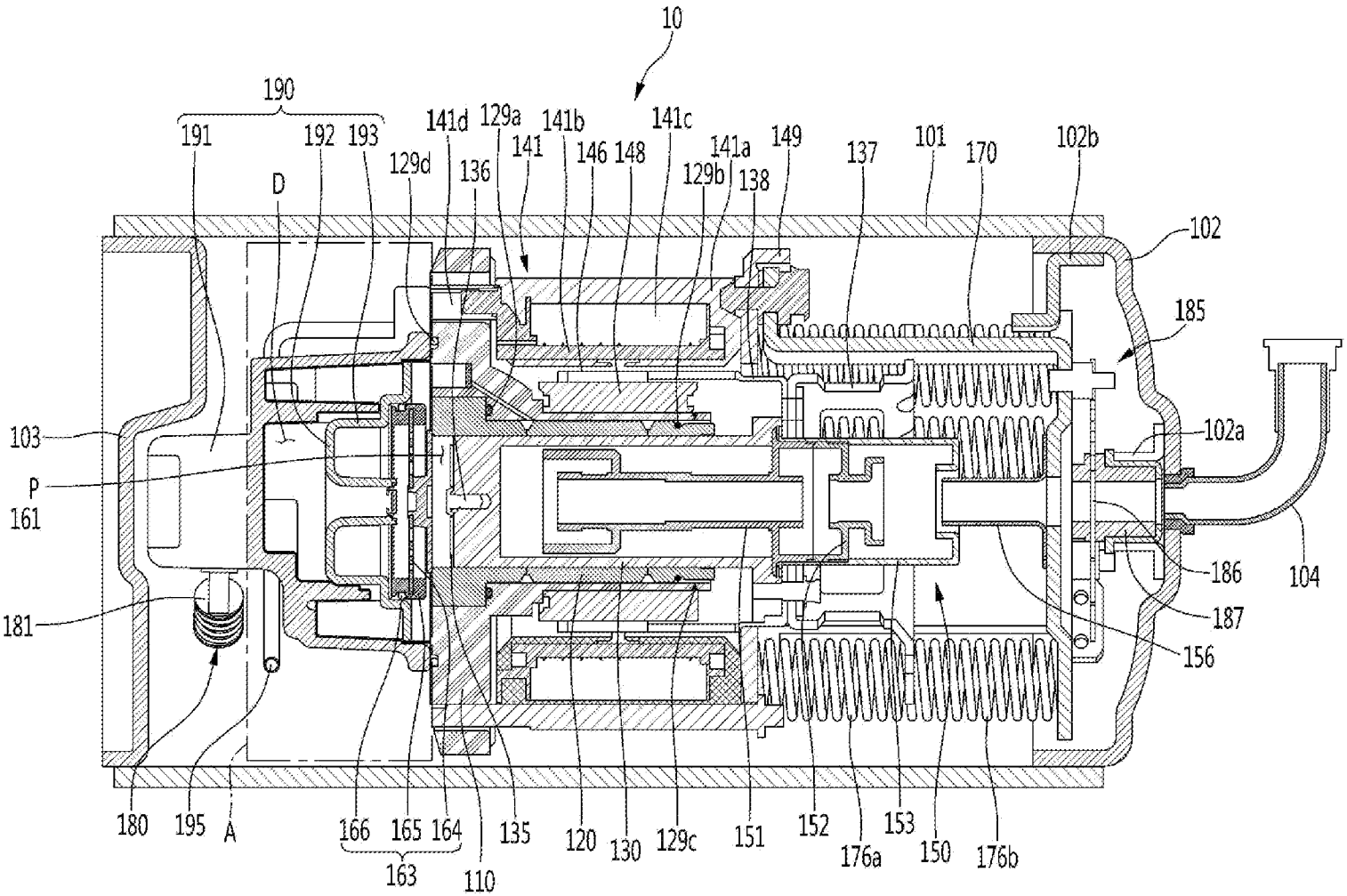
FIG. 3 is a cross-sectional view taken along line III-III' of FIG. 1.

FIG. 2 is an exploded view of an internal configuration of a linear compressor according to an embodiment of the present disclosure, and FIG. 3 is a cross-sectional view taken along line of FIG. 1.

Referring to FIGS. 2 and 3, the linear compressor 10 according to an embodiment of the present disclosure includes a frame 110, a cylinder 120, a piston 130 that reciprocates linearly in the interior of the cylinder 120 and a motor assembly 140 that is a linear motor that provides a driving force to the piston 130. When the motor assembly 140 is driven, the piston 130 may reciprocate in the axial direction.

Hereinafter, directions are defined.

The "axial direction" may be a direction in which the piston 130 reciprocates, that is, in the longitudinal direction in FIG. 3.

Among the "axial directions", a direction from the suction pipe 104 toward a compression space (P), that is, a direction to which the refrigerant flows is referred to as a "frontward direction" and a direction opposite thereto is referred to as a "rearward direction". When the piston 130 moves forward, the compression space (P) may be compressed.

On the other hand, the "radial direction" is a direction perpendicular to the direction in which the piston 130 reciprocates and may be a transverse direction of FIG. 3.

In addition, a direction away from the central axis of the piston 130 is defined as 'an outward direction' and the direction closer to the central axis of the piston 130 is defined as 'an inward direction'. The central axis of the piston 130, as described above, may coincide with the central axis of the shell 101.

The frame 110 may be a configuration for fixing the cylinder 120. The frame 110 is disposed to surround the cylinder 120.

That is, the cylinder 120 may be positioned to be accommodated inside the frame 110. For example, the cylinder 120 may be press-fitted to the interior of the frame 110.

In addition, the cylinder 120 and the frame 110 may be made of aluminum or an aluminum alloy material.

The cylinder 120 is configured to receive at least a portion of the piston 130.

The compression space P in which the refrigerant is compressed by the piston 130 is formed within the cylinder 120.

In this case, the compression space P may be a space defined between a suction valve 135 and a discharge valve 161, which will be described later.

The suction valve 135 is formed on one side of the compression space P and the discharge valve 161 is provided on the other side of the compression space P, that is, on the opposite side to the suction valve 135.

The piston 130 includes a substantially cylindrical piston body 131 and a piston flange 132 extending radially from the piston body 131.

The piston body 131 may reciprocate inside the cylinder 120 and the piston flange 132 may reciprocate outside the cylinder 120.

A suction hole 133 for introducing refrigerant into the compression space P is formed in a front portion of the piston body 131 and a suction valve 135 which selectively open the suction hole 133 is provided in front of the suction hole 133.

In addition, a fastening hole 136*a* to which a predetermined fastening member 136 is coupled is formed in the front portion of the piston body 131.

In detail, the fastening hole 136*a* is positioned at the center of the front portion of the piston body 131, and a plurality of suction holes 133 are formed to surround the fastening hole 136*a*.

In addition, the fastening member 136 is coupled to the fastening hole 136*a* by passing through the suction valve 135 to fix the suction valve 135 to the front portion of the piston body 131.

The motor assembly 140 may include an outer stator 141 fixed to the frame 110 to surround the cylinder 120, an inner stator 148 inwardly spaced apart from the outer stator 141 and a permanent magnet 146 disposed in a space between the outer stator 141 and the inner stator 148.

The permanent magnet 146 may reciprocate linearly by a mutual electromagnetic force between the outer stator 141 and the inner stator 148.

The permanent magnets 146 may be formed of a single magnet having one pole or may be formed by connecting a plurality of magnets having three poles.

The permanent magnet 146 may be installed in the magnet frame 138. The magnet frame 138 has a substantially cylindrical shape and may be arranged to be inserted into a space between the outer stator 141 and the inner stator 148.

Specifically, referring to FIG. 3, the magnet frame 138 is coupled to the piston flange 132 and may extend outwardly in the radial direction and be bent forward.

In this case, the permanent magnet 146 may be installed in a front portion of the magnet frame 138. Accordingly, when the permanent magnet 146 reciprocates, the piston 130 may reciprocate in the axial direction along with the permanent magnet 146 by the magnet frame 138.

The outer stator 141 includes coil winding structures 141*b*, 141*c*, and 141*d* and a stator core 141*a*. The coil winding structure includes a bobbin 141*b* and a coil 141*c* wound on the bobbin in the circumferential direction.

In addition, the coil winding structure further includes a terminal portion 141*d* that guides a power line connected to the coil 141*c* to be drawn out or exposed to the outside of the outer stator 141. The terminal portion 141*d* may be inserted into a terminal insertion hole 1104 (see FIG. 4) provided in the frame 110.

The stator core 141*a* includes a plurality of core blocks configured by stacking a plurality of laminations in the circumferential direction.

The plurality of core blocks may be disposed to surround at least a portion of the coil winding structure 141*a* or 141*b*.

A stator cover 149 is provided on one side of the outer stator 141. That is, one side of the outer stator 141 is supported by the frame 110, and the other side may be supported by the stator cover 149.

In addition, the linear compressor 10 further includes a cover fastening member 149*a* for fastening the stator cover 149 and the frame 110.

Figure 4:
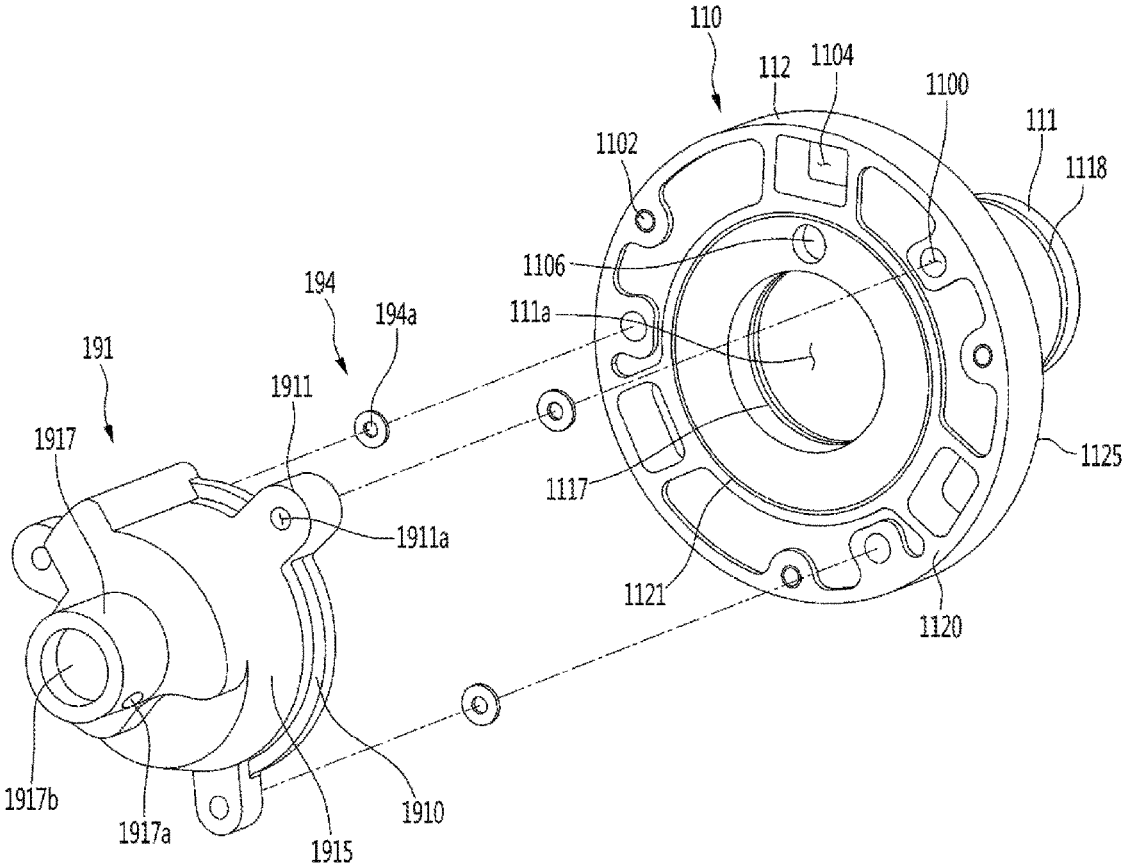
FIG. 4 is a view showing a discharge unit and a frame of a linear compressor according to an embodiment of the present disclosure.

The cover fastening member 149*a* may extend forward toward the frame 110 through the stator cover 149 and may be coupled to the stator fastening hole 1102 of the frame 110 (see FIG. 4).

The inner stator 148 is fixed to an outer periphery of the frame 110. The inner stator 148 is formed by stacking a plurality of laminations on the outer side of the frame 110 in the circumferential direction.

The linear compressor 10 may further include a suction muffler 150 coupled to the piston 130 to reduce noise caused due to refrigerant sucked through the suction pipe 104.

The refrigerant sucked through the suction pipe 104 flows into the inside of the piston 130 through the suction muffler 150. As an example, flow noise of the refrigerant may be reduced when the refrigerant passes through the suction muffler 150.

The suction muffler 150 includes a plurality of mufflers 151, 152, and 153. The plurality of mufflers may include a first muffler 151, a second muffler 152 and a third muffler 153 coupled to each other.

The first muffler 151 is positioned inside the piston 130 and the second muffler 152 is coupled to the rear side of the first muffler 151.

In addition, the third muffler 153 accommodates the second muffler 152 therein, and may extend to the rear side of the first muffler 151.

From the viewpoint of the flow direction of the refrigerant, the refrigerant sucked through the suction pipe 104 may pass through the third muffler 153, the second muffler 152 and the first muffler 151 in order. In this case, the flow noise of the refrigerant may be reduced.

The suction muffler 150 further includes a muffler filter 154. The muffler filter 154 may be positioned at an interface surface at which the first muffler 151 and the second muffler 152 are coupled to each other.

For example, the muffler filter 154 may have a circular shape, and an outer peripheral portion of the muffler filter 154 may be supported between the first and second mufflers 151 and 152.

In addition, the linear compressor 10 may further include a supporter 137 that supports the piston 130. The supporter 137 is coupled to the rear side of the piston 130, and the muffler 150 may be formed to pass through the supporter 137 inside thereof.

In addition, the piston flange 132, the magnet frame 138 and the supporter 137 may be fastened by the fastening member.

A balance weight 179 may be coupled to the supporter 137. The weight of the balance weight 179 may be determined based on an operation frequency range of the compressor body. In addition, a spring support 137*a* coupled to a first resonant spring 176*a*, which will be described later, may be coupled to the supporter 137.

In addition, the linear compressor 10 further includes a rear cover 170 coupled to the stator cover 149 and extending rearward.

The rear cover 170 includes three support legs, and the three support legs may be coupled to the rear surface of the stator cover 149.

A spacer 178 may be positioned between the three support legs and the rear surface of the stator cover 149.

The distance from the stator cover 149 to the rear end of the rear cover 170 may be determined by adjusting the thickness of the spacer 178. In addition, the rear cover 170 may be spring-supported to the supporter 137.

In addition, the linear compressor 10 may further include an inflow guide 156 coupled to the rear cover 170 to guide the inflow of the refrigerant into the suction muffler 150.

At least a portion of the inflow guide 156 may be inserted into the suction muffler 150.

The linear compressor 10 may further include a plurality of resonant springs 176*a* and 176*b* whose natural frequencies are adjusted to allow the piston 130 to resonate.

Specifically, the plurality of resonant springs 176*a* and 176*b* may include a first resonant spring 176*a* supported between the supporter 137 and the stator cover 149 and a second resonant springs 176*b* supported between the supporter 137 and the rear cover 170.

By the action of the plurality of resonant springs 176*a* and 176*b*, stable movement of the driving part reciprocating inside the linear compressor 10 is achieved, thus reducing occurrence of vibration or noise due to the movement of the driving part.

In addition, the linear compressor 10 includes a discharge unit 190 and a discharge valve assembly 160.

The discharge unit 190 defines a discharge space D of refrigerant discharged from the compression space P.

The discharge unit 190 includes a discharge cover 191 coupled to the front surface of the frame 110 and a discharge plenum 192 disposed on the inner side of the discharge cover 191. The discharge unit 190 will be described later in detail with reference to the accompanying drawings.

The discharge valve assembly 160 is coupled to the interior of the discharge unit 190, and discharges the refrigerant compressed in the compression space P to the discharge space D.

In addition, the discharge valve assembly 160 may include a discharge valve 161 and a spring assembly 240 that provides an elastic force in a direction in which the discharge valve 161 is in close contact with the front end of the cylinder 120.

The spring assembly 163 includes a plate spring type valve spring 164, a spring support 165 positioned at the edge of the valve spring 164 to support the valve spring 164, and a friction ring 166 fitted to the outer peripheral surface of the spring support 165.

A front center portion of the discharge valve 161 is fixedly coupled to the center of the valve spring 164. In addition, the rear surface of the discharge valve 161 is in close contact with the front surface (or front end) of the cylinder 120 by the elastic force of the valve spring 242.

When the pressure of the compression space P is equal to or greater than a discharge pressure, the valve spring 164 is elastically deformed toward the discharge plenum 192.

Further, the discharge valve 161 is spaced apart from the front end of the cylinder 120, and the refrigerant is discharged to the discharge space D (or discharge chamber) formed inside the discharge plenum 192 in the compression space P.

When the discharge valve 161 is supported on the front surface of the cylinder 120, the compression space P is maintained in a closed state. When the discharge valve 161 is separated from the front surface of the cylinder 120, the compression space P is opened so that the compressed refrigerant in the compression space P may be discharged.

In addition, the linear compressor 10 may further include a cover pipe 195. The cover pipe 195 discharges the refrigerant flowing into the discharge unit 190 to the outside.

In this case, one end of the cover pipe 195 is coupled to the discharge cover 191, the other end is coupled to the discharge pipe 105.

In addition, at least a portion of the cover pipe 195 is made of a flexible material and the cover pipe 195 may extend roundly along the inner peripheral surface of the shell 101.

In addition, the linear compressor 10 includes a plurality of sealing members for increasing a coupling force between the frame 110 and parts around the frame 110. The plurality of sealing members may have a ring shape.

In detail, the plurality of sealing members may include first and second sealing members 129*a* and 129*b* provided in a portion where the frame 110 and the cylinder 120 are coupled.

In this case, the first sealing member 129*a* is inserted into and installed in the frame 110, and the second sealing member 129*b* is inserted to and installed in the cylinder 120.

In addition, the plurality of sealing members may include a third sealing member 129*c* provided in a portion where the frame 110 and the inner stator 148 are coupled.

The third sealing member 129*c* may be inserted to and installed in the outer surface of the frame 110.

In addition, the plurality of sealing members may include a fourth sealing member 129*d* provided in a portion where the frame 110 and the discharge cover 191 are coupled. The fourth sealing member 129*d* may be inserted to and installed in the front surface of the frame 110.

In addition, the linear compressor 10 includes support devices 180 and 185 for fixing the compressor body to the interior of the shell 101.

The support devices include a first support device 185 disposed on the suction side of the compressor body and a second support device 180 disposed on the discharge side of the compressor body.

The first support device 185 includes a suction spring 186 provided in a circular plate spring shape and a suction spring support 187 fitted into the center of the suction spring 186.

The outer edge of the suction spring 186 may be fixed to the rear surface of the rear cover 170 by a fastening member.

The suction spring support 187 is coupled to a cover support 102*a* disposed at the center of the first shell cover 102. Accordingly, the rear end of the compressor body may be elastically supported at the center of the first shell cover 102.

In addition, a suction stopper 102*b* may be provided in the inner edge of the first shell cover 102.

The suction stopper 102*b* may prevent the body of the compressor, in particular, the motor assembly 140 from being damaged by collision with the shell 101 due to shaking, vibration, impact, or the like occurring during transport of the linear compressor 10.

In particular, the suction stopper 102*b* may be positioned adjacent to the rear cover 170.

Accordingly, when the linear compressor 10 is shaken, the rear cover 170 interferes with the suction stopper 102*b*, thereby preventing impact from being directly transferred to the motor assembly 140.

The second support device 180 includes a pair of discharge support portions 181 extending in the radial direction.

One end of the discharge support portion 181 is fixed to the discharge cover 191, and the other end thereof is in close contact with the inner peripheral surface of the shell 101. Accordingly, the discharge support portions 181 may support the compressor body in the radial direction.

For example, the pair of discharge support portions 181 are disposed in a state of being spaced apart from each other at an angle in a range of 90 to 120 degrees in a circumferential direction with a lower end closest to a bottom surface as a center. That is, a lower portion of the compressor body may be supported at two points.

In addition, the second support device 180 may include a discharge spring (not shown) installed in the axial direction. For example, the discharge spring (not shown) may be disposed between the upper end of the discharge cover 191 and the second shell cover 103.

Based on the configuration described above, a process of compressing refrigerant will be described.

When the linear compressor 10 is driven, the piston 130 reciprocates in the axial direction inside the cylinder 120.

That is, power is input to the motor assembly 140, and the piston 130 may be moved together with the permanent magnet 146.

Accordingly, refrigerant is sucked into the shell 101 through the suction pipe 104. Then, the sucked refrigerant flows through the muffler 150 and into the piston 130.

In this case, when the pressure of the compression space P is equal to or less than the suction pressure of the refrigerant, the suction valve 135 is deformed to open the compression space P. Accordingly, the sucked refrigerant accommodated in the interior of the piston 130 may flow into the compression space P.

In addition, when the pressure of the compression space P is greater than or equal to the suction pressure of the refrigerant, the compression space P is closed by the suction valve 135. Accordingly, the refrigerant accommodated in the compression space P may be compressed by the forward movement of the piston 130.

In addition, when the pressure of the compression space P is greater than or equal to the pressure of the discharge space D, the valve spring 164 is deformed forward and the discharge valve 161 is separated from the cylinder 120.

That is, the compression space P is opened by the discharge valve 161. Accordingly, the refrigerant compressed in the compression space P flows into the discharge space D through a space spaced between the discharge valve 161 and the cylinder 120.

In addition, when the pressure of the compression space P is less than or less than the pressure of the discharge space D, the valve spring 164 provides a restoring force to the discharge valve 161, and the discharge valve 161 is in close contact with the front end of the cylinder 120 again. That is, the compression space P is closed by the discharge valve 161.

The refrigerant flowing into the discharge space D is discharged to the outside of the shell 101 by passing through the cover pipe 195 and the discharge pipe 105 in turn.

In addition, the refrigerant discharged from the linear compressor 10 may be sucked into the linear compressor 10 and circulated through a predetermined device.

In this case, the compression space P and the discharge space D may be provided to communicate with each other by the coupling of the discharge unit 190 and the frame 110. Hereinafter, the discharge unit 190 and the frame 110 will be described in detail.

FIG. 4 is a view showing a discharge unit and a frame of a linear compressor according to an embodiment of the present disclosure.

Referring to FIG. 4, the discharge cover 191 and the frame 110 may be coupled through a predetermined fastening member (not shown). Particularly, the discharge cover 191 and the frame 110 may be coupled to each other by being supported at three points.

The frame 110 includes a frame body 111 extending in the axial direction and a frame flange 112 extending outward from the frame body 111 in the radial direction. In this case, the frame body 111 and the frame flange 112 may be integrally formed with each other.

The frame body 111 is provided in a cylindrical shape with an open upper end and an open lower end in the axial direction.

In addition, a cylinder accommodating portion 111*a* in which the cylinder 120 is accommodated is provided inside the frame body 111.

Accordingly, the cylinder 120 is accommodated on the inner side of the frame body 111 in the radial direction, and at least a portion of the piston 130 is accommodated on the inner side of the cylinder 120 in the radial direction.

In addition, the frame body 111 is formed with sealing member insertion portions 1117 and 1118.

The sealing member insertion portions include a first sealing member insertion portion 1117 formed on the inner side of the frame body 111 and into which the first sealing member 129*a* is inserted.

In addition, the sealing member insertion portions include a second sealing member insertion portion 1117 formed on the outer peripheral surface of the frame body 111 and into which the third sealing member 129*c* is inserted.

In addition, the inner stator 148 is coupled to the outer side of the frame body 111 in the radial direction.

In addition, the outer stator 141 is disposed on the outer side of the inner stator 148 in the radial direction, and the permanent magnet 146 is movably disposed between the inner stator 148 and the outer stator 141.

The frame flange 112 is provided in a disc shape having a predetermined thickness in the axial direction. Specifically, the frame flange 112 is provided in a ring shape having a predetermined thickness in the axial direction due to the cylinder accommodating portion 111*a* provided on the center side thereof in the radial direction.

In particular, the frame flange 112 extends from the front end of the frame body 111 in the radial direction.

Therefore, the inner stator 148, the permanent magnet 146, and the outer stator 141, which are disposed on the outer side of the frame body 111 in the radial direction, are disposed rearward rather than the frame flange 112 in the axial direction.

In addition, the frame flange 112 is formed with a plurality of openings which pass therethrough in the axial direction. In this case, the plurality of openings may include a discharge fastening hole 1100, a stator fastening hole 1102, and a terminal insertion opening 1104.

A predetermined fastening member (not shown) for fastening the discharge cover 191 and the frame 110 is inserted into the discharge fastening hole 1100. In detail, the fastening member (not shown) may pass through the discharge cover 191 and be inserted into the front of the frame flange 112.

The cover fastening member 149*a* described above is inserted into the stator fastening hole 1102.

The cover fastening member 149*a* couples the stator cover 149 and the frame flange 112 to fix the outer stator 141 disposed between the stator cover 149 and the frame flange 112 in the axial direction.

The terminal portion 141*d* of the outer stator 141 described above may be inserted into the terminal insertion opening 1104.

That is, the terminal portion 141*d* may pass through the terminal insertion opening 1104 from the rear side to front side of the frame 110 and may be drawn out or exposed to the outside.

In this case, the discharge fastening hole 1100, the stator fastening hole 1102, and the terminal insertion opening 1104 may be provided in plural and may be arranged to be spaced from one another in the circumferential direction.

For example, the discharge fastening hole 1100, the stator fastening hole 1102, and the terminal insertion opening 1104 may be provided in three, respectively, and may be disposed at intervals of 120 degrees in the circumferential direction.

In addition, the terminal insertion opening 1104, the discharge fastening hole 1100 and the stator fastening hole 1102 are arranged to be spaced from one another in the circumferential direction. In addition, the adjacent openings may be arranged to be spaced apart from one another by 30 degrees in the circumferential direction.

For example, each of the terminal insertion openings 1104 and each of the discharge fastening holes 1100 are arranged spaced apart from each other by 30 degrees in the circumferential direction. In addition, each of the discharge fastening holes 1100 and each of the stator fastening holes 1102 are arranged spaced apart from each other by 30 degrees in the circumferential direction.

On the other hand, each of the terminal insertion openings 1104 and each of the stator fastening holes 1102 are disposed spaced apart from each other by 60 degrees in the circumferential direction.

The above-described arrangements are made based on circumferential centers of the terminal insertion opening 1104, the discharge fastening holes 1100, and the stator fastening holes 1102.

In this case, the front surface of the frame flange 112 is referred to as a discharge frame surface 1120, and the rear surface is referred to as a motor frame surface 1125. That is, the discharge frame surface 1120 and the motor frame surface 1125 correspond to surfaces facing in the axial direction.

Specifically, the discharge frame surface 1120 corresponds to a surface in contact with the discharge cover 191. In addition, the motor frame surface 1125 corresponds to a surface in contact with the outer stator 141.

A fourth sealing member insertion portion 1121 into which the fourth sealing member 129*d* is inserted is formed in the discharge frame surface 1120.

Specifically, the fourth sealing member insertion portion 1121 is provided in a ring shape and is formed by being recessed axially rearward from the discharge frame surface 1120.

In addition, the fourth sealing member 129*d* is provided in a ring shape having a diameter corresponding to the fourth sealing member insertion portion 1121. The fourth sealing member 129*d* may prevent the refrigerant from flowing out between the discharge cover 191 and the frame 110.

In addition, a gas hole 1106 communicating with a gas flow path 1130 to be described later is formed in the discharge frame surface 1120.

The gas hole 1106 is formed by being recessed axially rearward from the discharge frame surface 1120. In addition, the gas hole 1106 may be equipped with a gas filter 1107 (see FIG. 11) for filtering out foreign substances in the flowing gas.

In this case, the gas hole 1106 is formed in the inner side further inward than the fourth sealing member insertion portion 1121 in the radial direction. In addition, the terminal insertion opening 1104, the discharge fastening hole 1100 and the stator fastening hole 1102 are formed on the outer side further than the fourth sealing member insertion portion 1121 in the radial direction.

In addition, referring to FIG. 4, a predetermined depression structure may be formed on the discharge frame surface 1120. The depression structure is to prevent the heat of the discharge refrigerant from being transferred and is not limited in the depth and shape of the depression.

Hereinafter, the outer shape of the discharge cover 191 coupled to the frame 110 will be described.

The appearance of the discharge cover 191 may be provided in a bowl shape, as a whole. Specifically, the discharge cover 191 may be provided in a shape of which one surface is open and in which an internal space is defined.

In particular, the discharge cover 191 may be arranged such that the rear portion is open in the axial direction. In this case, the discharge plenum 192 is disposed in the interior space.

The discharge cover 191 includes a cover flange portion 1910 coupled with the frame 110, a chamber portion 1915 extending forward from the cover flange portion 1910 in the axial direction, and a support device fixing portion 1917 extending from the chamber portion 1915 in the axial direction.

The cover flange portion 1910 may be in close contact with and coupled to the front surface of the frame 110. In detail, the cover flange portion 1910 is disposed in close contact with the discharge frame surface 1120.

Further, the cover flange portion 1910 has a predetermined thickness in the axial direction and is formed to extend in the radial direction. Accordingly, the cover flange portion 1910 may be provided in a disk shape as a whole.

In particular, the cover flange portion 1910 may be provided with a diameter corresponding to the fourth sealing member insertion portion 1121. Specifically, the diameter of the cover flange portion 1910 is slightly larger than the diameter of the fourth sealing member insertion portion 1121.

That is, the cover flange portion 1910 is relatively small than the diameter of the discharge frame surface 1120. For example, the diameter of the cover flange portion 1910 may be larger than the diameter of the discharge frame surface 1120 0.6 to 0.8 times. In a conventional linear compressor, the diameter of the cover flange portion is larger than the diameter of the discharge frame surface 0.9 times or more.

The structure is to minimize heat transferred from the cover flange portion 1910 to the frame 110. Specifically, as the cover flange portion 1910 is disposed in close contact with the discharge frame surface 1120, the heat of the discharge cover 191 is conducted to the frame 110 through the cover flange portion 1910.

In this case, since the heat conduction is proportional to a contact area, the amount of heat conducted is changed according to the contact area between the cover flange portion 1910 and the discharge frame surface 1120.

That is, it is possible to minimize the contact area with the discharge frame surface 1120 by minimizing the diameter of the cover flange portion 1910. Accordingly, the amount of heat conducted from the discharge cover 191 to the frame 110 may be minimized.

In addition, as the area in contact with the cover flange portion 1910 decreases, a relatively large portion of the discharge frame surface 1120 may be exposed to the interior of the shell 101.

The surface exposed to the interior of the shell 101 is in contact with refrigerant (hereinafter, referred to as shell refrigerant) accommodated inside the shell 101, heat transfer being achieved.

In particular, since the shell refrigerant is provided at a temperature similar to that of the sucked refrigerant, convective heat transfer is achieved from the frame 110 to the shell refrigerant. In addition, since the convective heat transfer is proportional to the contact area, the larger the surface exposed to the interior of the shell 101, the amount of heat released increases.

In summary, as the area of the cover flange portion 1910 becomes smaller, less heat is conducted to the frame 110 through the discharge cover 191. In addition, heat release from the frame 110 to the shell refrigerant may be effectively made.

Therefore, the temperature of the frame 110 may be maintained at a relatively low temperature. In addition, less heat is transferred to the cylinder 120 and the piston 130 disposed inside the frame 110. As a result, it is possible to prevent the temperature of the sucked refrigerant from rising and improve the compression efficiency.

An opening communicating with the open axial rear is formed in a central portion of the cover flange portion 1910.

Through the opening, the discharge plenum 192 may be mounted in the interior of the discharge cover 191. In addition, the opening may be an opening in which the discharge valve assembly 160 is installed.

In addition, the cover flange portion 1910 includes a flange fastening hole 1911*a* through which a fastening member (not shown) for coupling with the frame 110 passes. The flange fastening hole 1911*a* is provided in plural by passing through the cover flange portion 1910 in the axial direction.

In particular, the flange fastening holes 1911*a* may be provided in sizes, number, and positions corresponding to the discharge fastening holes 1100. Therefore, the three flange fastening holes 1911*a* may be provided to be spaced apart from one another by 120 degrees in the circumferential direction.

In this case, the discharge cover 191 includes a cover fastening portion 1911 protruding from the cover flange portion 1910 in the radial direction to define the flange fastening holes 1911*a*.

That is, the flange fastening holes 1911*a* are disposed on the outer side of the cover flange portion 1910*a* in the radial direction. In other words, the discharge fastening holes 1100 may be positioned on the outer side of the cover flange portion 1910*a* in the radial direction.

The three cover fastening portions 1911 may be provided to be spaced apart from one another by 120 degrees in the circumferential direction to correspond to the flange fastening holes 1911*a*.

In addition, the edge of the cover fastening portion 1911 may be formed thicker than the cover flange portion 1910 in the axial direction. The flange fastening hole 1911*a* is a portion which is coupled by a fastening member to preventing damage because a relatively large external force is applied.

The chamber portion 1915 and the support device fixing portion 1917 may be formed in a cylindrical shape.

Specifically, the chamber portion 1915 and the support device fixing portion 1917 each have a predetermined outer diameter in the radial direction and are formed to extend in the axial direction. In this case, the outer diameter of the shell fixing portion 1917 is smaller than the outer diameter of the chamber portion 1915.

In addition, the outer diameter of the chamber portion 1915 is formed to be smaller than the outer diameter of the cover flange portion 1910. That is, the discharge cover 191 is formed with a stepped portion in which the outer diameter gradually decreases as it goes toward the front in the axial direction.

In addition, the chamber portion 1915 and the support device fixing portion 1917 may be opened at rear sides in the axial direction. Accordingly, the chamber portion 1915 and the support device fixing portion 1917 are formed to have an appearance of which side surfaces have a cylindrical shape and a front surface has a circle shape.

A pipe coupling portion (not shown) to which the cover pipe 195 is coupled may be further included in the chamber portion 1915.

In particular, the cover pipe 195 may be coupled to the chamber portion 1915 to communicate with any one of the plurality of discharge spaces D. Specifically, the cover pipe 195 may communicate with the discharge space D through which the refrigerant is finally passed.

In addition, at least a portion of the upper surface of the chamber portion 1915 may be recessed to avoid interference with the cover pipe 195. Through this, when the cover pipe 195 is coupled to the chamber portion 1915, it is possible to prevent the cover pipe 195 from contacting the front surface of the chamber portion 1915.

Fixing fasteners 1917*a* and 1917*b* to which a second support device 180 described above is coupled are formed in the support device fixing portion 1917.

The fixing fasteners include a first fixing fastener 1917*a* to which the discharge support portion 181 is coupled, and a second fixing fastener 1917*b* in which a discharge spring (not shown) is installed.

The first fixing fastener 1917*a* may be formed by being recessed radially inward from or passing through the support device fixing portion 1917. In addition, a pair of first fixing fasteners 1917*a* are provided to be spaced apart from each other in the circumferential direction to correspond to a pair of discharge support portions 181.

The second fixing fastener 1917*b* may be recessed axially rearward from the front surface of the support device fixing portion 1917. Accordingly, at least a portion of a discharge spring (not shown) may be inserted into the second fixing fastener 1917*b*.

In this case, the discharge cover 191 according to the present disclosure may be integrally manufactured through aluminum die casting. Therefore, unlike a conventional discharge cover, the welding process may be omitted in the case of the discharge cover 191 of the present disclosure.

Therefore, a process of manufacturing the discharge cover 191 is simplified and, as a result, product defects are minimized, thus reducing a product cost. In addition, since there is no dimensional tolerance due to welding, leakage of the refrigerant may be prevented.

Accordingly, the cover flange portion 1910, the chamber portion 1915, and the support device fixing portion 1917 described above may be integrally formed.

In addition, the linear compressor 10 includes a gasket 194 disposed between the frame 110 and the discharge cover 191.

Specifically, the gasket 194 is disposed between the cover fastening portion 1911 and the discharge frame surface 1120.

In particular, the gasket 194 may be positioned at a portion where the frame 110 and the discharge cover 191 are fastened to each other That is, the gasket 194 may be configured to more closely fasten the frame 110 and the discharge cover 191.

A plurality of gaskets 194 may be provided. In particular, the plurality of gaskets 194 are provided in the number and position corresponding to the flange fastening holes 1911*a* and the discharge fastening holes 1100. That is, three gaskets 194 may be provided to be spaced apart from one another by 120 degrees in the circumferential direction.

In addition, the gasket 194 may have a ring shape with a gasket through hole 194*a* formed at the center side. The gasket through hole 194*a* may have a size corresponding to the flange fastening hole 1911*a* and the discharge fastening hole 1100.

In addition, the outer diameter of the gasket 194 may be formed smaller than the outer side of the cover coupling portion 1911.

Accordingly, when the gasket through hole 194*a* is disposed to coincide with the flange fastening hole 1911*a*, the gasket 194 may be positioned on the inner side of the cover coupling portion 1911.

The discharge cover 191, the gasket 194 and the frame 110 are stacked such that the flange fastening hole 1911*a*, the gasket through hole 194*a* and the discharge fastening hole 1100 are disposed in order from the upper side to the lower side in the axial direction.

In addition, as a fastening member passes through the flange fastening hole 1911*a*, the gasket through hole 194*a*, and the discharge fastening hole 1100, the discharge cover 191, the gasket 194, and the frame 110 may be coupled.

Hereinafter, the inner shape of the discharge cover 191 and the discharge plenum 192 will be described in detail.

Figure 5:
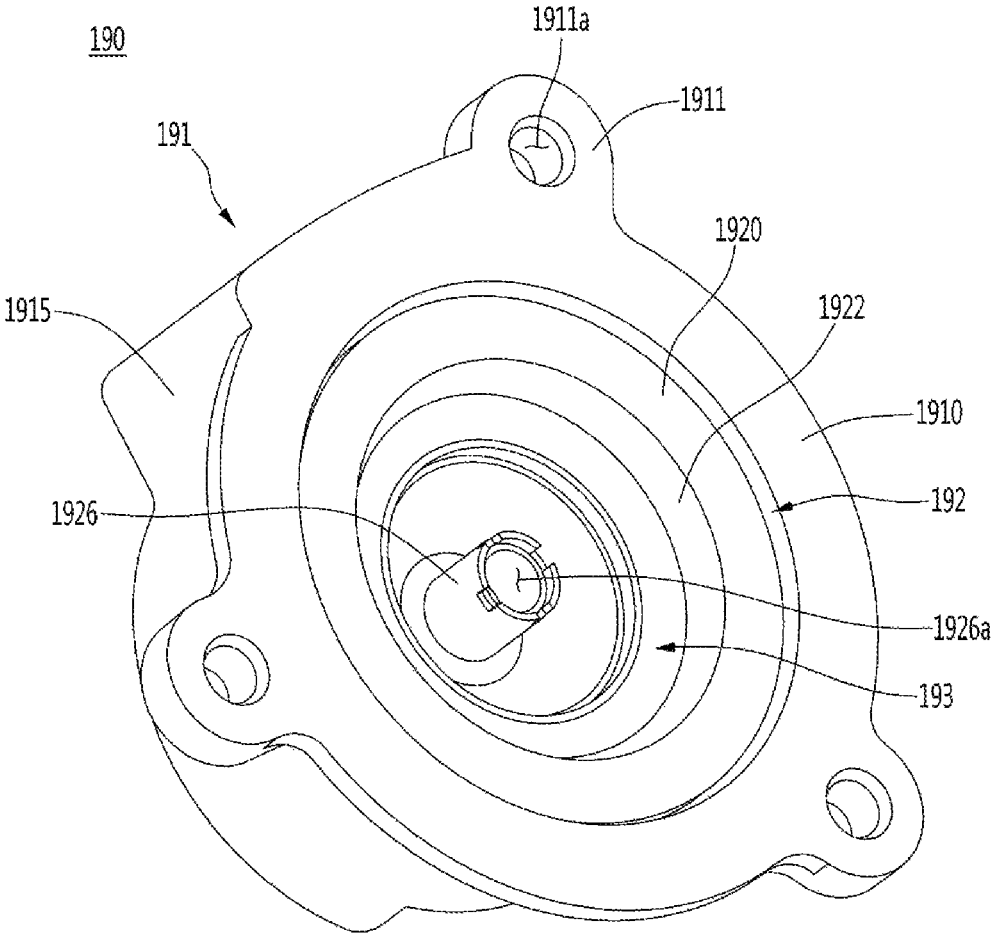
FIG. 5 is a view showing a discharge unit of a linear compressor according to an embodiment of the present disclosure.
Figure 6:
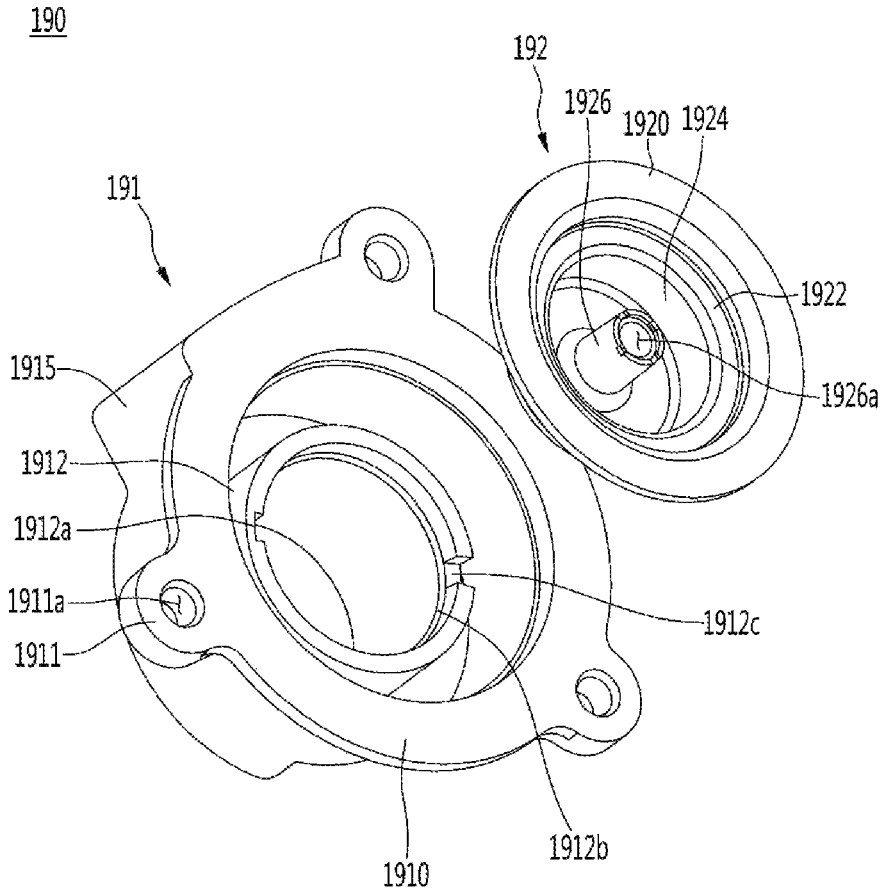
FIG. 6 is an exploded view of a discharge unit of a linear compressor according to an embodiment of the present disclosure.
Figure 7:
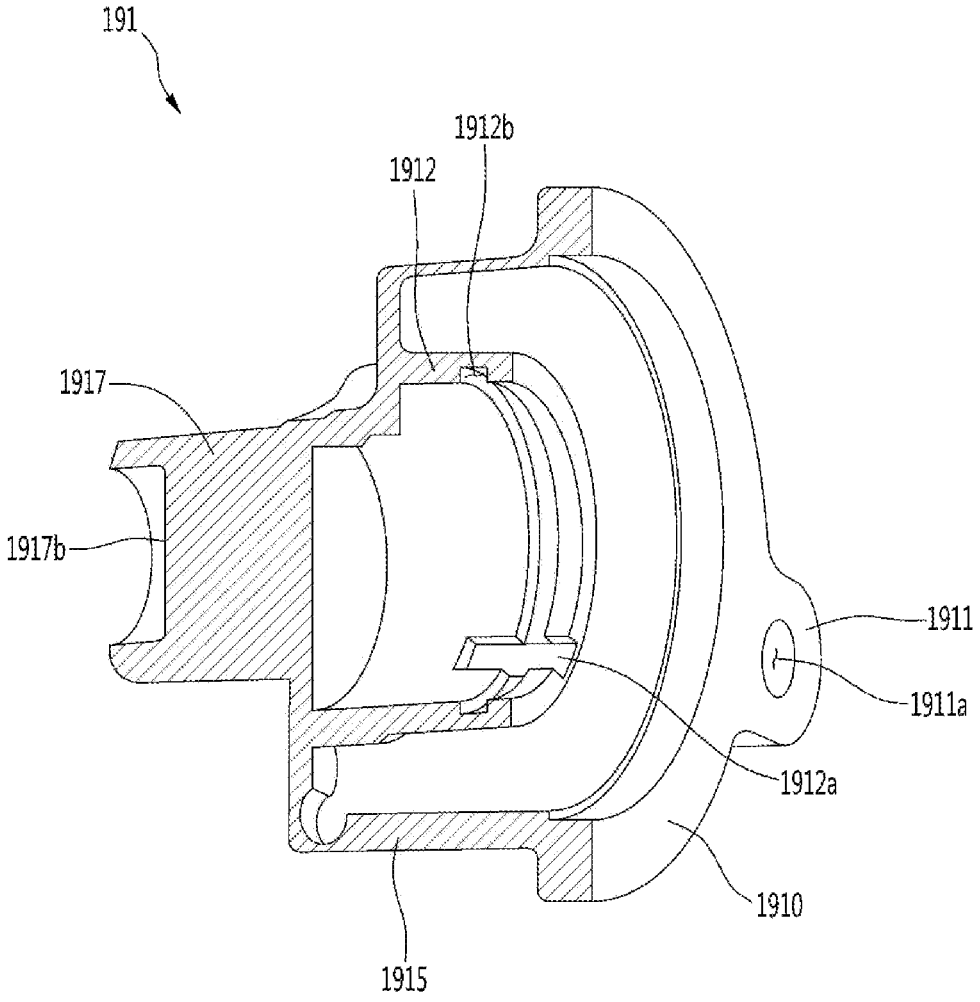
FIG. 7 is a view of a discharge cover of a linear compressor which is shown cut according to an embodiment of the present disclosure.
Figure 8:
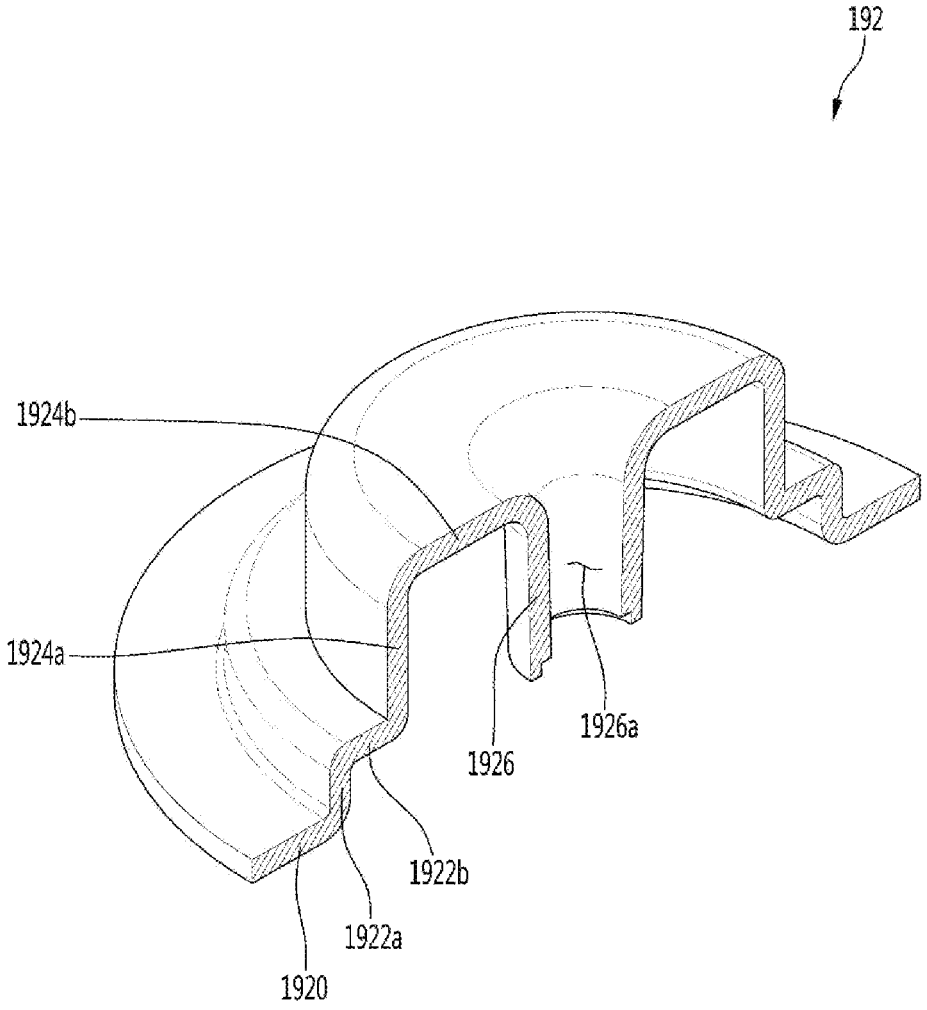
FIG. 8 is a view of a discharge plenum of a linear compressor which is shown cut according to an embodiment of the present disclosure.

FIG. 5 is a view showing a discharge unit of a linear compressor according to an embodiment of the present disclosure, and FIG. 6 is an exploded view of a discharge unit of a linear compressor according to an embodiment of the present disclosure. Furthermore, FIG. 7 is a view of a discharge cover of a linear compressor which is shown cut according to an embodiment of the present disclosure, and FIG. 8 is a view of a discharge plenum of a linear compressor which is shown cut according to an embodiment of the present disclosure.

To facilitate understanding, FIGS. 5 and 6 show the rear of the discharge unit 190 in the axial direction. In addition, FIGS. 7 and 8 show the discharge cover 191 and the discharge plenum 192 which is shown cut along the axial center.

As shown in FIGS. 5 and 6, the discharge unit 190 includes the discharge cover 191 and the discharge plenum 192. In this case, the discharge cover 191 and the discharge plenum 192 may be formed of different materials and by manufacturing methods.

The discharge plenum 192 is coupled to the interior of the discharge cover 191. In particular, a plurality of discharge spaces D are defined by the coupling of the discharge cover 191 and the discharge plenum 192. The discharge space D may be a space through which the refrigerant discharged from the compression space P flows.

First, the inner shape of the discharge cover 191 will be described with reference to FIG. 7. As described above, the discharge cover 191 may have one surface open and an internal space defined therein. In particular, the inner space may be formed on the inner side of the cover flange portion 1910 and the chamber portion 1915.

In addition, the inner space may be divided into an upper space positioned on the upper side of the plenum flange 1920 of the discharge plenum 192 in the axial direction and a lower space positioned on the lower side in the axial direction, which will be described later. In this case, the upper space may correspond to the discharge space D.

Also, the upper space, that is, the discharge space D may be formed on the inner side of the chamber portion 1915, and the lower space may be formed on the inner side of the cover flange portion 1910.

The lower space may be a space in which the discharge valve assembly 160 is installed. The frame 110 is disposed at the lower side of the lower space. In detail, the lower space is defined on the upper side of the discharge frame surface 1120.

In addition, the upper space and the lower space may be a single cylindrical shape extending in the axial direction.

In this case, a radial diameter of the space defined by the upper space and the lower space is referred to as an inner diameter R (see FIG. 10) of the discharge cover 191. In addition, the interior of the discharge cover 191 may be formed to be stepped.

In addition, the discharge cover 191 includes a partition sleeve 1912 partitioning the upper space.

The partition sleeve 1912 may have a cylindrical shape extending from the interior of the upper space in the axial direction. In particular, the partition sleeve 1912 may extend axially rearward from the front surface of the chamber portion 1915.

In addition, the outer diameter of the partition sleeve 1912 is formed smaller than the inner diameter R of the discharge cover 191.

Specifically, the partition sleeve 1912 is spaced apart from the inner surface of the discharge cover 191 in the radial direction such that a predetermined space is defined between the partition sleeve 1912 and the inner surface of the discharge cover 191.

Accordingly, the upper space may be divided into inner and outer sides by the partition sleeve 1912 in the radial direction.

In this case, a first discharge chamber D1 and a second discharge chamber D2 are formed on the inner side of the partition sleeve 1912 in the radial direction. In addition, a third discharge chamber D3 is formed on the outer side of the partition sleeve 1912 in the radial direction.

In addition, the discharge plenum 192 may be fitted in the interior of the partition sleeve 1912. Specifically, at least a portion of the discharge plenum 192 may be in close contact with the inner surface of the partition sleeve 1912 and inserted into the partition sleeve 1912.

In addition, a first guide groove 1912*a*, a second guide groove 1912*b*, and a third guide groove 1912*c* may be formed in the partition sleeve 1912.

The first guide groove 1912*a* may be recessed radially outward from the inner surface of the partition sleeve 1912 and may extend in the axial direction.

In particular, the first guide groove 1912*a* extends from the front to the rear in the radial direction from a position at which the discharge plenum 192 is inserted thereto.

The second guide groove 1912*b* may be recessed radially outward from the inner surface of the partition sleeve 1912 and may formed to extend in the circumferential direction.

In particular, the second guide groove 1912*b* is formed in the inner surface of the partition sleeve 1912 in contact with the discharge plenum 192. Further, the second guide groove 1912*b* may communicate with the first guide groove 1912*a*.

The third guide groove 1912*c* may be recessed axially frontward from the rear end of the partition sleeve 1912.

Accordingly, the rear end of the partition sleeve 1912 may be formed to be stepped. Further, the third guide groove 1912*c* may communicate with the second guide groove 1912*b*.

That is, the third guide groove 1912*c* may be formed by being recessed to a portion where the second guide groove 1912*b* is formed.

In addition, the third guide groove 1912*c* and the first guide groove 1912*a* may be spaced apart from each other in the circumferential direction. For example, the third guide groove 1912*c* may be formed at a position facing the first guide groove 1912*a*, that is, a position spaced apart from the first guide groove 1912*a* by 180 degrees in the circumferential direction.

Through this structure, refrigerant flowing into the second guide groove 1912*b* may have an increased residence time in the second guide groove 1912*b*. Accordingly, there is an effect that the pulsation noise of the refrigerant is effectively reduced.

Hereinafter, the discharge plenum 192 will be described with reference to FIGS. 6 and 8.

The discharge plenum 192 includes a plenum flange 1920, a plenum seating portion 1922, a plenum body 1924, and a plenum extension 1926.

In this case, the discharge plenum 192 may be integrally formed. That is, the portions of the discharge plenum 192, which will be described later, are distinguished from one another for convenience of description.

In addition, the portions of the discharge plenum 192 may be formed with the same thickness. Accordingly, the plenum flange 1920, the plenum seating portion 1922, the plenum body 1924, and the plenum extension 1926 may be provided in an extended shape with the same thickness.

The plenum flange 1920 forms a lower surface of the discharge plenum 192 in the axial direction.

That is, the plenum flange 1920 is positioned at the lowest side of the discharge plenum 192 in the axial direction. In detail, the plenum flange 1920 may have a ring shape having a thickness in the axial direction and extending in the radial direction.

In this case, the outer diameter of the plenum flange 1920 has a size corresponding to the inner diameter R of the discharge cover 191. In this case, the correspondence means that the same or the assembly tolerance is considered in the inner diameter R of the discharge cover 191.

Accordingly, the plenum flange 1920 may be installed such that an outer surface thereof is in close contact with the interior of the discharge cover 191.

As described above, the upper side of the plenum flange 1920 in the axial direction corresponds to the upper space, and the lower side of the plenum flange 1920 in the axial direction corresponds to the lower space.

In particular, the plenum flange 1920 may close the rear of the third discharge chamber D3 in the axial direction. That is, as the plenum flange 1920 is seated on the inner side of the discharge cover 191, it is possible to prevent the refrigerant in the third discharge chamber D3 from flowing to the rear in the axial direction.

The inner diameter of the plenum flange 1920 is provided to have a size corresponding to the spring assembly 163. In detail, the plenum flange 1920 may extend radially inward adjacent to the outer surface of the spring support 165.

The plenum seating portion 1922 extends inward from the plenum flange 1920 in the radial direction such that the spring assembly 163 is seated thereon.

In detail, the plenum seating portion 1922 extends by being bent axially frontward from the inner end of the plenum flange 1920 in the radial direction and is bent again by extending radially inward.

Accordingly, the plenum seating portion 1922 may have a cylindrical shape of which one end positioned on the front side in the axial direction is bent inward in the radial direction, as a whole.

In this case, the plenum flange 1920 includes a first plenum seating portion 1922*a* extending forward in the axial direction and a second plenum seating portion 1922*b* extending inward from the first plenum seating portion 1922*a* in the radial direction.

The first plenum seating portion 1922*a* extends axially frontward along the outer surface of the spring support 165.

In this case, the length of the first plenum seating portion 1922*a* in the axial direction may be shorter than the length of the outer surface of the spring support 165 in the axial direction. That is, at least a portion of the spring support 165 is seated on the plenum seating portion 1922.

In this case, the first plenum seating portion 1922*a* is in contact with a friction ring 166. In detail, the friction ring 166 is installed such that at least a portion thereof protrudes from the outer peripheral surface of the spring support 165. Accordingly, when the spring assembly 163 is seated on the plenum seating portion 1922, the friction ring 166 may be in close contact with the first plenum seating portion 1922*a*.

In particular, the friction ring 166 may be formed of an elastic material such as rubber whose shape is deformed by external force. Accordingly, the friction ring 166 may prevent a gap from being caused between the first plenum seating portion 1922*a* and the outer peripheral surface of the spring support 165.

In addition, it is possible to prevent the spring assembly 163 from running idle in the circumferential direction due to the friction ring 166. In addition, since the spring support 165 does not directly strike the discharge plenum 192 due to the friction ring 166, it is possible to minimize the occurrence of strike noise.

The second plenum seating portion 1922*b* extends axially inward in the radial direction along the front surface of the spring support 165. In addition, the second plenum seating portion 1922*b* abuts the rear end of the partition sleeve 1912 in the axial direction.

In other words, the partition sleeve 1912 extends axially rearward from the front inner side of the chamber portion 1915 to the second plenum seating portion 1922*b*.

That is, the second plenum seating portion 1922*b* may be disposed between the spring support 165 and the partition sleeve 1912 in the axial direction.

In this case, the second plenum seating portion 1922*b* and the rear end of the partition sleeve 1912 in the axial direction are in close contact with each other.

That is, the plenum seating portion 1922 and the partition sleeve 1912 are in close contact with each other in the axial direction. Accordingly, it is possible to prevent the refrigerant from flowing between the second plenum seating portion 1922*b* and the partition sleeve 1912.

As described above, the third guide groove 1912*c* is recessed axially frontward from the rear end of the partition sleeve 1912.

Accordingly, the refrigerant may flow by passing through between the partition sleeve 1912 and the second plenum seating portion 1922*b* along the third guide groove 1912*c*. That is, the third guide groove 1912*c* forms a flow path which the refrigerant passes through the partition sleeve 1912 and the second plenum seating portion 1922*b*.

The plenum body 1924 extends radially inward from the plenum seating portion 1922 to form a first discharge chamber D1.

Specifically, the plenum body 1924 extends by being bent axially frontward from the inner end of the second plenum seating portion 1922*b* in the radial direction and extending again by being bent radially inward.

Accordingly, the plenum body 1924 may have a cylindrical shape in which one end positioned on the front side in the axial direction is bent inward in the radial direction, as a whole.

In this case, the plenum body 1924 may include a first plenum body 1924*a* extending axially frontward and a second plenum body 1924*b* extending radially inward from the first plenum body 1924*a*.

The first plenum body 1924*a* extends axially frontward along the inner surface of the partition sleeve 1912.

In this case, the length of the first plenum body 1924*a* in the axial direction may be shorter than the length of the partition sleeve 1912 in the axial direction. That is, the first plenum body 1924*a* is disposed on the lower portion of the partition sleeve 1912.

In this case, the first plenum body 1924*a* and the inner surface of the partition sleeve 1912 are in close contact with each other.

That is, the plenum body 1924 and the partition sleeve 1912 are in close contact with each other in the radial direction. Accordingly, it is possible to prevent the refrigerant from flowing between the first plenum body 1924*a* and the partition sleeve 1912.

As described above, the first and second seating grooves 1912*a* and 1912*b* are recessed in the inner surface of the partition sleeve 1912. Accordingly, the refrigerant may flow by passing through between the partition sleeve 1912 and the first plenum body 1924*a* along the first and second seating grooves 1912*a* and 1912*b*.

That is, the first and second seating grooves 1912*a* and 1912*b* form a flow path of refrigerant passing through the partition sleeve 1912 and the first plenum body 1924*a*.

The second plenum body 1924*b* extends radially inward from the front end of the first plenum body 1924*a* in the axial direction.

In this case, the second plenum body 1924*b* may have a ring shape extending radially inward with an outer diameter at the front end of the first plenum body 1924*a* in the axial direction. That is, an opening is formed in the center of the second plenum body 1924*b*.

Also, the first discharge chamber D1 and the second discharge chamber D2 may be separated from each other based on the second plenum body 1924*b*.

Specifically, the first discharge chamber D1 is formed on the rear side of the second plenum body 1924*b* in the axial direction and the second discharge chamber D2 is formed on the front side of the second plenum body 1924*b* in the axial direction.

The plenum extension 1926 extends axially rearward from the inner end of the second plenum body 1924*b* in the radial direction. That is, the opening formed in the center of the second plenum body 1924*b* extends axially rearward to form a predetermined passage.

The passage formed by the plenum extension 1926 as described above is referred to as a plenum guide 1926*a*. The plenum guide 1926*a* functions as a passage through which the refrigerant in the first discharge chamber D1 flows into the second discharge chamber D2.

In particular, the refrigerant in the first discharge chamber D1 may flow axially frontward along the plenum guide 1926*a*.

In addition, the plenum extension 1926 may extend axially rearward to abut the spring assembly 163.

In detail, the rear end of the plenum extension 1926 in the axial direction may be contact with the front surface of the spring support 165. In other words, the plenum extension 1926 may extend rearward in the axial direction than the second plenum seating portion 1922*b*.

In the shape of the discharge plenum 192, the plenum flange 1920 extends in the radial direction.

In addition, the plenum seating portion 1922, the plenum body 1924, and the plenum extension 1926 extend from the inner end of the plenum flange 1920 in the radial direction.

In this case, the discharge unit 190 further includes an insulating plenum 193. Hereinafter, the insulating plenum 193 will be described with reference to the drawings.

Figure 9:
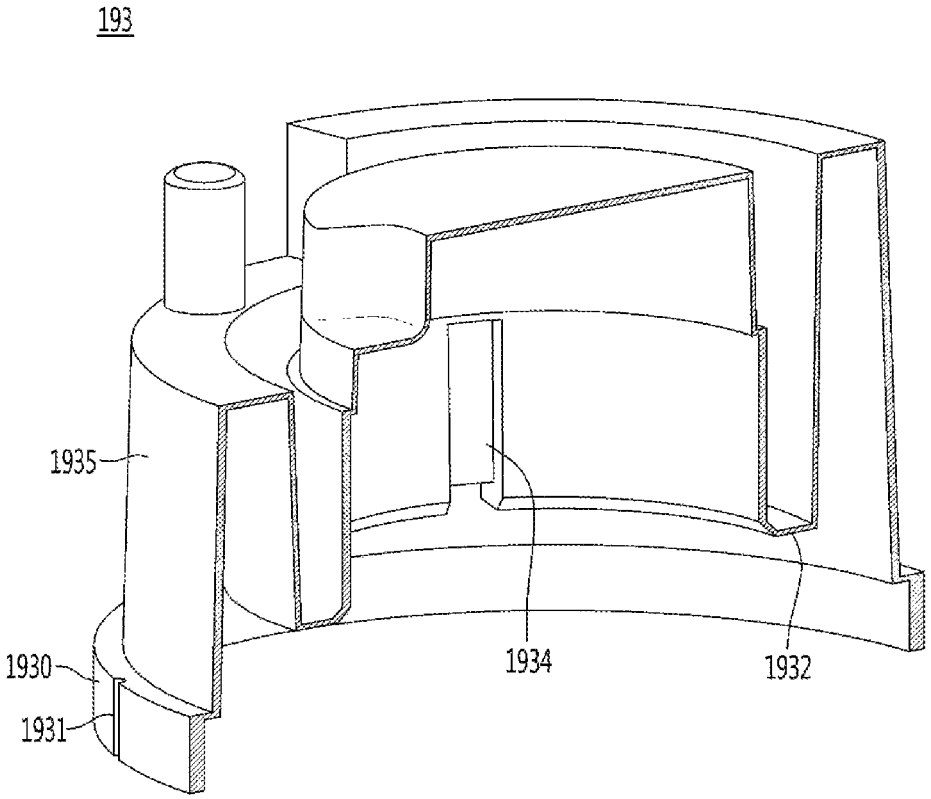
FIG. 9 is a view of an insulating plenum of a linear compressor which is shown cut according to an embodiment of the present disclosure.
Figure 10:
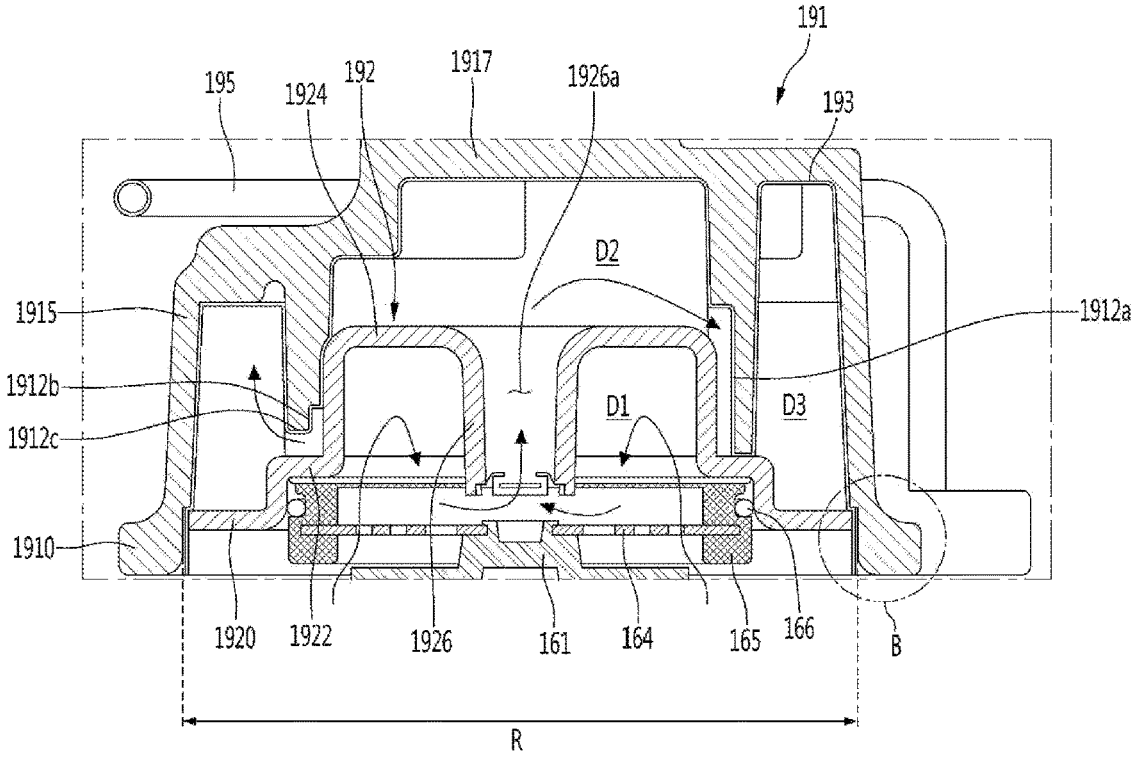
FIG. 10 is a view showing a portion 'A' of FIG. 3 together with the flow of refrigerant.

FIG. 9 is a view of an insulating plenum of a linear compressor which is shown cut according to an embodiment of the present disclosure, and FIG. 10 is a view showing a portion 'A' of FIG. 3 together with the flow of refrigerant.

Referring to FIGS. 9 and 10, the insulating plenum 193 is provided in a shape corresponding to the inner surface of the discharge cover 191 and is disposed in close contact with the inner surface of the discharge cover 191.

In particular, the insulating plenum 193 is provided to have a relatively thin thickness and may be disposed to cover the inner surface of the discharge cover 191.

In FIGS. 9 and 10, the thickness of the insulating plenum 193 is illustrated as being relatively thick for convenience of illustration. In practice, the insulating plenum 193 may be formed to be very thin and disposed in close contact with the interior of the discharge cover 191.

In FIG. 9, the shape of the insulating plenum 193 corresponding to the inner surface of the discharge cover 191 is schematically illustrated. Since the insulating plenum 193 is provided in a shape corresponding to the discharge cover 191, it does not have a unique shape in itself.

Specifically, the insulating plenum 193 is formed to have a first portion 1930 corresponding to the inner surface of the cover flange portion 1910 and a second portion 1935 corresponding to the inner surface of the chamber portion 1915.

In addition, the insulating plenum 193 may be provided with a portion 1932 corresponding to the partition sleeve 1912 and a portion 1934 corresponding to the guide groove 1912*a*, 1912*b* or 1912*c*.

Since the insulating plenum 193 is disposed to cover the inner surface of the discharge cover 191, the inner surface of the discharge cover 191 described above may actually correspond to the insulating plenum 193. For example, the discharge plenum 192 is disposed inside the discharge cover 191 so as to be in contact with the insulating plenum 193.

In particular, the insulating plenum 193 may function such that the discharge plenum 192 is press-fitted in and fixed to the discharge cover 191.

In detail, at least a portion of the insulating plenum 193 is elastically deformable, and the discharge plenum 192 may be fixed while deforming the portion of the insulating plenum 193.

Referring to FIG. 10, it can be seen that the outer end of the plenum flange 1920 in the radial direction is disposed in close contact with the insulating plenum 193. That is, the outer end of the plenum flange 1920 is press-fitted in the insulating plenum 193 to fix the discharge plenum 192.

In addition, the refrigerant flowing into the discharge space D is not in direct contact with the inner surface of the discharge cover 191 by the insulating plenum 193.

That is, the insulating plenum 193 may prevent heat from being transferred to the discharge cover 191. Accordingly, the temperature of the discharge cover 191 coupled with the frame 110 is lowered to effectively reduce heat transferred to the sucked refrigerant.

In particular, the insulating plenum 193 may be formed of a material having a relatively low thermal conductivity. In addition, the insulating plenum 193 may be formed of a material having a lower thermal conductivity than the discharge plenum 192.

That is, the discharge unit 190 includes the discharge cover 191, the discharge plenum 192 and the insulating plenum 193 formed of different materials. For example, the discharge cover 191 may be made of aluminum, the discharge plenum 191 may be made of steel, and the insulating plenum may be made of plastic.

Hereinafter, the flow of the refrigerant in the discharge space D will be described in detail on the basis of the configuration described above. In this case, the inner surface of the discharge cover 191 may be the insulating plenum 193. For convenience of description, the insulating plenum 193 will be described as a part of the discharge cover 191.

As shown in FIG. 10, the discharge space D is divided into a plurality of spaces. As described above, the discharge space D includes the first discharge chamber D1, the second discharge chamber D2, and the third discharge chamber D3

In addition, the first, second, and third discharge chambers D1, D2, and D3 are defined by the discharge cover 191 and the discharge plenum 192.

The first discharge chamber D1 is defined by the discharge plenum 192, and the second and third discharge chambers D2 and D3 are defined between the discharge plenum 192 and the discharge cover 191.

In addition, the second discharge chamber D2 is formed in front of the first discharge chamber D1 in the axial direction, and the third discharge chamber D3 is formed on the outer side of the first and second discharge chambers D1 and D2 in the radial direction.

In addition, the discharge cover 191 and the discharge plenum 192 are tightly coupled to each other. In addition, the discharge valve assembly 160 may be seated on the rear side of the discharge plenum 192.

When the pressure of the compression space P is greater than or equal to the pressure of the discharge space D, the valve spring 164 is elastically deformed toward the discharge plenum 192.

Accordingly, the discharge valve 161 may open the compression space P so that the compressed refrigerant in the compression space P may flow into the discharge space D. The refrigerant discharged from the compression space P by the opening of the discharge valve 161 is guided to the first discharge chamber D1 through the valve spring 164.

The refrigerant which had been guided to the first discharge chamber D1 is guided to the second discharge chamber D2 through the plenum guide 1926*a*.

In this case, the refrigerant in the first discharge chamber D1 passes through the plenum guide 1926*a* having a small cross-sectional area and is then discharged into the second discharge chamber D2 having a large cross-sectional area. Accordingly, noise due to pulsation of the refrigerant may be significantly reduced.

The refrigerant guided to the second discharge chamber D2 is moved axially rearward along the first guide groove 1912*a* and is then moved along the second guide groove 1912*b* in the circumferential direction. Furthermore, the refrigerant moved in the circumferential direction along the second guide groove 1912*b* is guided to the third discharge chamber D3 through the third guide groove 1912*c*.

In this case, the refrigerant in the second discharge chamber D2 passes through the first guide groove 1912*a*, the second guide groove 1912*b* and the third guide groove 1912*c* which have narrow cross-sectional areas, and is then discharged to the third discharge chamber D3 having a large cross-sectional area. Accordingly, noise due to the pulsation of the refrigerant may be reduced once more.

In this case, the third discharge chamber D3 is provided to communicate with the cover pipe 195. Therefore, the refrigerant guided to the third discharge chamber D3 flows to the cover pipe 195.

In addition, the refrigerant guided to the cover pipe 195 may be discharged to the outside of the linear compressor 10 through the discharge pipe 105.

As described above, the refrigerant discharged from the compression space P may flow through the discharge space D defined in the discharge unit 190. In particular, the refrigerant discharged from the compression space P may sequentially pass through the first discharge chamber D1, the second discharge chamber D2, and the third discharge chamber D3.

In this case, the linear compressor 10 is provided with a structure that functions as a bearing using refrigerant. Hereinafter, the refrigerant used as the bearing is referred to as a bearing refrigerant. The bearing refrigerant may be a part of the refrigerant discharged from the compression space P.

Hereinafter, the flow of the bearing refrigerant supplied to the frame 110, the cylinder 120, and the piston 130 will be described.

Figure 11:
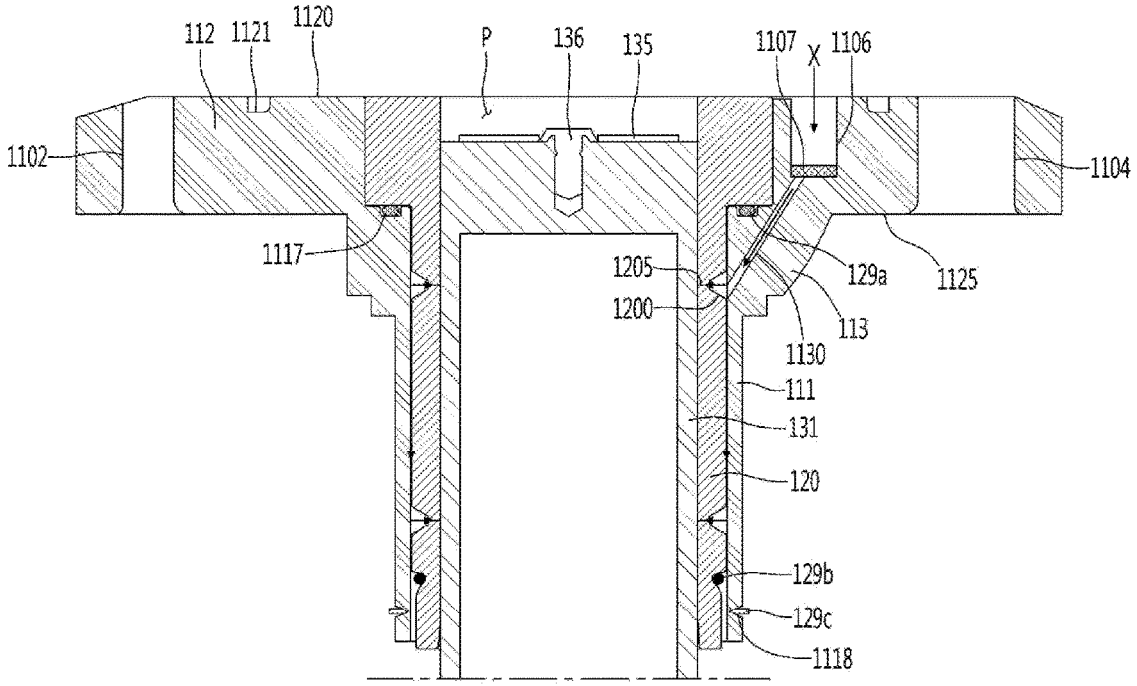
FIG. 11 is a view showing a frame of a linear compressor according to an embodiment of the present disclosure together with a flow of bearing refrigerant.

FIG. 11 is a view showing a frame of a linear compressor according to an embodiment of the present disclosure together with a flow of bearing refrigerant.

As shown in FIG. 11, the frame 110 includes a frame connecting portion 113 extending obliquely from the frame flange 112 toward the frame body 111.

In this case, a plurality of the frame connection portions 113 may be provided and disposed to be spaced apart from one another at equal intervals in the circumferential direction. For example, three frame connection portions 113 may be provided, and may be spaced apart from one another by 120 degrees in the circumferential direction.

A gas flow path 1130 for guiding the refrigerant discharged from the compression space P to the cylinder 120 is formed in the frame connection portion 113.

In this case, the gas flow path 1130 may be formed only in one of the plurality of frame connection portions 113. In addition, the frame connection portion 113 in which the gas flow path 1130 is not formed may be provided to prevent deformation of the frame 110.

The gas flow passage 1130 may pass through the interior of the frame connection portion 113.

In addition, the gas flow path 1130 may be formed to be inclined in correspondence with the frame connection portion 113. In particular, the gas flow path 1130 extends from the frame flange 112 and may extend to the frame body 111 by passing through the frame connection portion 113.

In detail, one end of the gas flow path 1130 is connected to the gas hole 1106. As described above, the gas hole 1106 is recessed axially rearward from the discharge frame surface 1120.

In addition, the gas filter 1107 may be installed on one side of the gas hole 1106 communicating with the gas flow path 1130.

For example, the gas hole 1106 may have a cylindrical shape. In addition, the gas filter 1107 is provided as a circular filter and may be disposed in the rear end of the gas hole 1106 in the axial direction.

The other end of the gas flow path 1130 is in communication with the outer peripheral surface of the cylinder 120. In particular, the gas flow path 1130 may communicate with a gas inlet portion 1200 formed in the outer peripheral surface of the cylinder 120.

The gas inlet portion 121*a* is recessed radially inward from the outer peripheral surface of the cylinder body 121.

In particular, the gas inlet portion 1200 may be formed to have a smaller area as it goes inward in the radial direction. Accordingly, the inner end of the gas inlet portion 1200 in the radial direction may form a tip end.

The gas inlet portion 121*a* extends in the circumferential direction along the outer peripheral surface of the cylinder 120 to have a circular shape.

Also, a plurality gas inlet portions 1200 may be provided in the axial direction. For example, two gas inlet portions 1200 may be provided, and one gas inlet portion 121*a* may be disposed to communicate with the gas flow path 1130.

A cylinder filter member (not shown) may be installed in the gas inlet portion 1200. The cylinder filter member (not shown) may block foreign substances having a predetermined size or more from entering the cylinder 120. In addition, the cylinder filter member may adsorb oil contained in refrigerant.

In addition, the cylinder 120 includes a cylinder nozzle 1205 extending radially inward from the gas inlet portion 1200.

In this case, the cylinder nozzle 1205 may extend to the inner surface of the cylinder 120. That is, the cylinder nozzle 1205 may be a portion in communication with the outer peripheral surface of the piston 130.

In particular, the cylinder nozzle 1205 extends from the inner end of the gas inlet portion 1200 in the radial direction. That is, the cylinder nozzle 1205 may be formed to have a very small size.

The flow of the bearing refrigerant through the structure described above will be described. A part of the refrigerant discharged from the compression space P through the gas hole 1106, that is, the bearing refrigerant flows. In this case, the flow of the bearing refrigerant flowing into the gas hole 1106 is referred to as a bearing flow path X.

The bearing refrigerant flowing into the gas hole 1106 through the bearing flow path X passes through the gas filter 1107 and flows into the gas flow path 1130.

Then, the bearing refrigerant may flow into the gas inlet portion 1200 through the gas flow path 1130 and may be distributed along the outer surface of the cylinder 120.

In addition, a part of the bearing refrigerant may flow to the outer surface of the piston 130 through the cylinder nozzle 1205. The bearing refrigerant flowing to the outer surface of the piston 130 may be distributed along the outer surface of the piston 130.

As described above, a tiny space is defined between the piston 130 and the cylinder 120 through the bearing refrigerant distributed on the outer surface of the piston 130. That is, the bearing refrigerant provides a floating force to the piston 130 to perform a gas bearing function for the piston 130.

Through this, it is possible to prevent wear of the piston 130 and the cylinder 120 due to the reciprocating motion of the piston 130. That is, it is possible to achieve a bearing function through the bearing refrigerant without using oil.

At this time, the refrigerant discharged from the compression space P flows through the bearing flow path X.

In other words, the refrigerant flowing through the discharge space D flows through the bearing flow path X. In particular, the refrigerant flowing through the third discharge space D3 may flow into the bearing flow path X.

In this case, the refrigerant flowing through the third discharge space D3 is a compressed refrigerant and corresponds to a high-temperature refrigerant. When the refrigerant flows into the frame 110, the cylinder 120 and the piston 130 as the bearing refrigerant as it is, the temperature of the frame 110, the cylinder 120 and the piston 130 may be raised. That is, the temperature of sucked refrigerant accommodated in the piston 130 may increase, and compression efficiency may decrease.

Accordingly, the linear compressor 10 is provided with a structure in which the bearing refrigerant flows into the bearing flow path X at a relatively low temperature. Hereinafter, the flow of the bearing refrigerant supplied from the discharge unit 190 to the bearing flow path X will be described through various embodiments.

Figure 12:
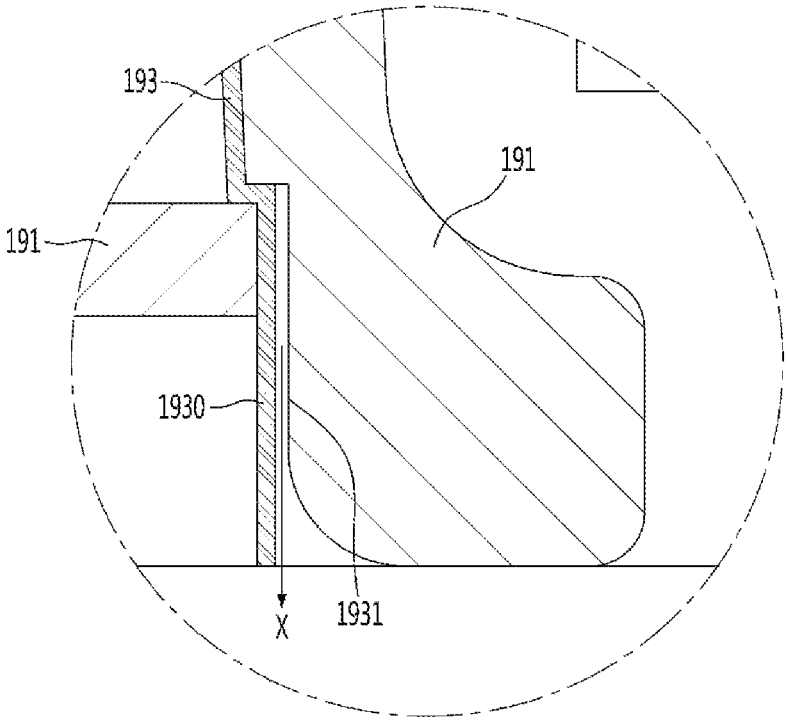
FIG. 12 is a view showing a bearing refrigerant flow path of a linear compressor according to a first embodiment of the present disclosure.

FIG. 12 is a view showing a bearing refrigerant flow path of a linear compressor according to a first embodiment of the present disclosure. FIG. 12 is a view showing a portion 'B' of FIG. 10 together with a bearing flow path X.

As illustrated in FIG. 12, the bearing flow path X may be formed between the insulating plenum 193 and the discharge cover 191.

Referring to FIG. 9, a bearing guide groove 1931 may be formed on the outer side of the insulating plenum 193. In particular, the bearing guide groove 1931 may be formed in the first portion 1930 corresponding to the inner surface of the cover flange portion 1910.

As described above, the insulating plenum 193 is disposed in close contact with the inner surface of the discharge cover 191.

Accordingly, an air layer is positioned between the insulating plenum 193 and the discharge cover 191. Heat transfer from the discharge space D to the discharge cover 191 may be further reduced by the air layer.

A part of the refrigerant flowing through the discharge space D may be flowed into the air layer. The refrigerant flowing through the discharge space D is a high-temperature gas refrigerant, and the flow is not completely limited by the insulating plenum 193. Accordingly, a part of refrigerant may flow between the insulating plenum 193 and the discharge cover 191.

In this case, the refrigerant flowing between the heat insulating plenum 193 and the discharge cover 191 may be discharged to the bearing flow path X along the bearing guide groove 1931.

Figure 13:
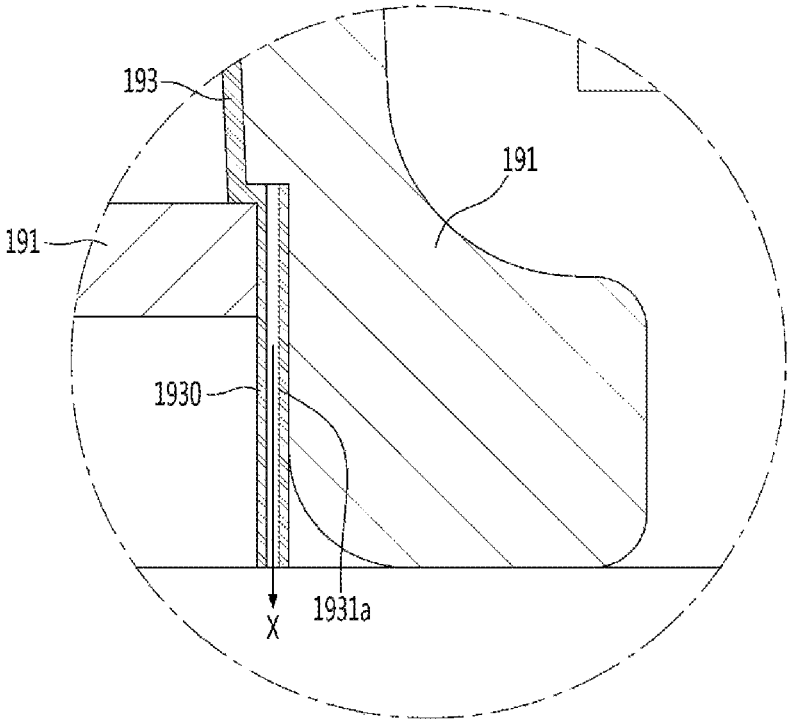
FIG. 13 is a view showing a bearing refrigerant flow path of a linear compressor according to a second embodiment of the present disclosure.

FIG. 13 is a view showing a bearing refrigerant flow path of a linear compressor according to a second embodiment of the present disclosure.

As shown in FIG. 13, the bearing flow path X may be formed between the insulating plenum 193. That is, a bearing guide groove 1931*a* may be formed inside the insulating plenum 193. In particular, the bearing guide groove 1931*a* may be formed in the first portion 1930 corresponding to the inner surface of the cover flange portion 1910.

As described above, partial refrigerant may flow between the insulating plenum 193 and the discharge cover 191 and may be discharged to the bearing flow path X along the bearing guide groove 1931*a*.

In summary, the bearing guide groove 1931 of the first embodiment is formed in a recessed groove shape on the outer side of the insulating plenum 193.

Then, the bearing guide groove 1931*a* of the second embodiment is formed in the shape of a opened passage on the inner side of the insulating plenum 193. The shapes are exemplary and the present disclosure is not limited thereto.

It is possible to effectively reduce heat transferred to the discharge cover 191 through the insulating plenum 193. Accordingly, the heat transferred to the frame 110 connected to the discharge cover 191 and the cylinder 120 and the piston 130 accommodated in the frame 110 is reduced. As a result, heat transferred to the sucked refrigerant is reduced, thus securing compression efficiency.

According to the linear compressor according to the embodiment of the present disclosure having the above configuration, following effects may be accomplished.

since the insulating plenum is disposed in close contact with the inner surface of the discharge cover, it is possible to prevent the temperature of the discharge cover from being raised due to the refrigerant discharged from the compression space.

Accordingly, heat transferred from the discharge cover to the frame is reduced, thus preventing temperature of the cylinder and the piston from being raised. As a result, there is an advantage that it is possible to prevent a reduction in compression efficiency due to overheating of the sucked gas accommodated in the piston.

In addition, it is possible to prevent the temperature of the cylinder and the piston from being raised by lowering the temperature of the bearing refrigerant supplied between the cylinder and the piston.

In addition, it is possible to reduce conductive heat transfer from the discharge cover to the frame by minimizing the surface area of the frame covered by the discharge cover. In addition, the surface area where the frame is exposed to the refrigerant in the space inside the shell is increased, and convective heat transfer (heat release) to the refrigerant in the shell is increased.

In addition, in order to minimize the area in contact with the frame, at least a portion of the discharge cover is cut, and accordingly, the material cost of the discharge cover is reduced.

What is claimed is:

1. A linear compressor comprising:

a cylinder that defines a compression space for compressing refrigerant;

a frame that receives the cylinder; and a discharge assembly that defines a discharge space for discharging the refrigerant, wherein the discharge space receives the refrigerant from the compression space, wherein the discharge assembly includes:

a discharge cover connected to the frame;

a discharge plenum disposed on the discharge cover and defining the discharge space; and an insulating plenum having a shape that corresponds to at least part of an inner surface of the discharge cover and contacts the at least part of the inner surface of the discharge cover, wherein the insulating plenum includes a bearing guide groove, and wherein the refrigerant flows through the bearing guide groove to the frame between the insulating plenum and the discharge cover.

2. The linear compressor of claim 1, wherein the discharge plenum is press-fitted to the insulating plenum.

3. The linear compressor of claim 2, wherein the discharge plenum includes:

a plenum body; and a plenum flange extending radially from the plenum body, wherein a radially outer end of the plenum flange is press-fitted to the insulating plenum.

4. The linear compressor of claim 3, wherein the discharge cover defines an inner space, wherein the inner space includes a first space and a second space, the first space being positioned at a first axial side of the plenum flange, and the second space being positioned at a second axial side of the plenum flange opposite to the first axial side of the plenum flange, and wherein the plenum body is disposed in the first space.

5. The linear compressor of claim 1, wherein the insulating plenum includes a material having a lower thermal conductivity than the discharge plenum.

6. The linear compressor of claim 5, wherein the discharge cover, the discharge plenum and the insulating plenum include different materials from each other.

7. The linear compressor of claim 6, wherein the discharge cover includes aluminum, wherein the discharge plenum includes steel, and wherein the insulating plenum includes plastic.

8. The linear compressor of claim 1, wherein the discharge cover comprises:

a chamber portion; and a cover flange portion that extends radially from the chamber portion and that is connected to the frame, wherein the insulating plenum includes a first portion and a second portion, the first portion at least partially contacting an inner surface of the cover flange portion, and the second portion at least partially contacting an inner surface of the chamber portion.

9. The linear compressor of claim 8, wherein the cover flange portion includes:

a flange body defining a circular opening; and a flange coupling portion having a flange fastening hole that receives a coupling member, wherein the coupling member is coupled to the frame, wherein at least a portion of the flange coupling portion is positioned at an outer side of the flange body in a radial direction.

10. The linear compressor of claim 1, wherein the discharge space includes:

a first discharge chamber defined at an inner side of the discharge plenum;

a second discharge chamber defined between the discharge cover and the discharge plenum and disposed axially opposite to the first discharge chamber; and a third discharge chamber defined between the discharge cover and the discharge plenum and disposed radially outside the first discharge chamber and the second discharge chamber.

11. The linear compressor of claim 10, further comprising:

a cover pipe connected to the discharge cover and fluidly communicating with the third discharge chamber, wherein the refrigerant that is discharged from the compression space flows to the cover pipe by passing through the first discharge chamber, the second discharge chamber, and the third discharge chamber sequentially.

12. The linear compressor of claim 1, wherein an air layer is defined between the insulating plenum and the discharge cover.

13. The linear compressor of claim 1, wherein the bearing guide groove is defined at a surface of the insulating plenum that contacts the discharge cover.

14. The linear compressor of claim 13, wherein the bearing guide groove extends through the insulating plenum.

15. A linear compressor comprising:

a cylinder that defines a compression space for compressing refrigerant;

a frame that receives the cylinder; and a discharge assembly that defines a discharge space for discharging the refrigerant, wherein the discharge space receives the refrigerant from the compression space, wherein the discharge assembly includes:

a discharge cover including a chamber portion and a cover flange portion extending radially from the chamber portion, wherein the cover flange portion is seated on a surface of the frame and connected to the frame, and an insulating plenum having a shape that corresponds to at least part of inner surfaces of the cover flange portion and the chamber portion and contacts at least part of an inner surface of the discharge cover, wherein the insulating plenum includes a bearing guide groove, and wherein the bearing guide groove is defined at a surface of the insulating plenum that contacts the discharge cover.

16. The linear compressor of claim 15, wherein the discharge assembly further includes:

a discharge plenum that is press-fitted to the insulating plenum.

17. The linear compressor of claim 15, wherein the chamber portion has an outer diameter that is smaller than an outer diameter of the cover flange portion.

18. The linear compressor of claim 15, wherein the discharge space is defined inside the chamber portion.

19. The linear compressor of claim 15, wherein the insulating plenum includes a first portion and a second portion, the first portion at least partially contacting the inner surface of the cover flange portion, and the second portion at least partially contacting the inner surface of the chamber portion.

* * * * *